US010464332B2

(12) United States Patent
Koganehira et al.

(10) Patent No.: US 10,464,332 B2
(45) **Date of Patent: *Nov. 5, 2019**

(54) PRINTING APPARATUS

(71) Applicant: SEIKO EPSON CORPORATION, Tokyo (JP)

(72) Inventors: Shuichi Koganehira, Nagano (JP); Yasuhiko Kosugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/352,990

(22) Filed: Nov. 16, 2016

(65) Prior Publication Data

US 2017/0157943 A1 Jun. 8, 2017

(30) Foreign Application Priority Data

Dec. 7, 2015 (JP) ..... 2015-238447
Dec. 7, 2015 (JP) ..... 2015-238450
Apr. 8, 2016 (JP) ..... 2016-077878
Apr. 28, 2016 (JP) ..... 2016-090385

(51) Int. Cl.
*B41J 2/175* (2006.01)
*B41J 29/38* (2006.01)

(52) U.S. Cl.
CPC ..... *B41J 2/17566* (2013.01); *B41J 2/1752* (2013.01); *B41J 2/1753* (2013.01); *B41J 29/38* (2013.01); *B41J 2002/17569* (2013.01)

(58) Field of Classification Search
CPC ..... B41J 29/38; B41J 2/17566
USPC ..... 347/7
See application file for complete search history.

(56) References Cited

U.S. PATENT DOCUMENTS

2002/0091585 A1 7/2002 Asauchi et al.
2008/0071605 A1 3/2008 Asauchi et al.
2014/0063089 A1 3/2014 Kosugi

FOREIGN PATENT DOCUMENTS

JP 2002-273989 A 9/2002
JP 2008-254395 A 10/2008
JP 2011-073208 A 4/2011
JP 2014-046545 A 3/2014
JP 2014-058098 A 4/2014

*Primary Examiner* — Lam S Nguyen

(57) ABSTRACT

A printing apparatus includes a slot to and from which a memory unit storing permitted usage amount information can be attached and removed, and a processing unit that carries out a process for updating estimated ink amount information that is information for estimating an amount of the ink in an ink holding unit. When the memory unit is attached to the slot, the processing unit carries out a charging process that updates the estimated ink amount information using the permitted usage amount information in the memory unit, on the basis of a process for determining whether or not consumed ink amount expressed by the estimated ink amount information exceeds a prescribed threshold (WTH). The processing unit executes forced charging process that executes the charging process in the case where there is an instruction from an operator of the printing apparatus before the prescribed threshold WTH is exceeded.

7 Claims, 21 Drawing Sheets

PRINTING APPARATUS

BACKGROUND

1. Technical Field

The present invention relates to printing apparatuses.

2. Related Art

User-replaceable ink cartridges (an example of an ink holding unit) used in ink jet printers, which are an example of a printing apparatus, are sometimes provided with storage devices for managing a consumed ink amount, or in other words, an amount of ink consumed from the ink cartridge. In printing apparatuses where an ink tank (an example of an ink holding unit) provided in the printing apparatus is filled with ink, too, a memory unit including a storage device is sometimes installed in the printing apparatus in order to manage the consumed ink amount. Information such as the color of the ink, the consumed ink amount, and so on is stored in this storage device.

JP-A-2014-46545 discloses a technique in which each time a total consumed ink amount on a printing apparatus main unit (called simply a "main unit" hereinafter) side exceeds a first threshold (WTH1), information of the main unit-side total consumed ink amount managed on the main unit side is written into a memory unit. JP-A-2014-46545 also discloses a technique where the stated write is carried out before the main unit-side total consumed ink amount exceeds a second threshold (WTH2), and in the case where WTH2 has been exceeded, the memory unit is set to an invalid state and no additional writes are carried out.

Meanwhile, JP-A-2008-254395 discloses a technique in which an identification number and a capacity of a set memory card are stored in a storage unit of a printing apparatus. In JP-A-2008-254395, the storage unit of the printing apparatus stocks liquid stock amount information so that a liquid stock amount is added on the basis of the information in the set memory card, regardless of whether it is before or after ink has been refilled. JP-A-2011-73208 also discloses a technique in which an ink amount in a separate memory is added to an amount of ink that can be used by a printer.

According to the technique of JP-A-2014-46545, a process for writing into the memory unit is carried out until the main unit-side total consumed ink amount exceeds WTH2, and thus printing operations will stop if a user removed the memory unit before the main unit-side total consumed ink amount exceeds WTH2. Thus in order to print continuously, the user is forced to replace the memory unit during a specific period, namely after the main unit-side total consumed ink amount has exceeded WTH2 but before printing operations end in response to a determination that the ink has run out (that is, a case where the main unit-side total consumed ink amount has exceeded a third threshold WTH3). This places a heavy burden on the user. The printing operations will stop unless this replacement is made, and there is thus a problem that it is difficult to use the printing apparatus continuously for long periods of time.

According to the techniques disclosed in JP-A-2008-254395 and JP-A-2011-73208, information in a plurality of memory cards or in a separate memory card can be added to the liquid stock amount on the main unit side, and printing can be carried out continuously until the amount of ink corresponding to the ink amount stored on the main unit side runs out. However, in the case where an error occurs in the printing apparatus main unit and the ink amount information is lost, the information loss may render the stocked (charged) ink unusable, which is an undesirable situation.

Thus what is needed is a printing apparatus that can properly manage ink even during breakdowns while making it possible to print continuously with little burden on a user.

SUMMARY

Having been conceived in order to solve at least part of the aforementioned problems, an advantage of the invention is that a printing apparatus can be implemented as the following aspects or application examples.

Application Example 1

A printing apparatus according to this application example includes a slot to and from which a memory unit storing permitted usage amount information of ink can be attached and removed, and a processing unit that carries out a process for updating estimated ink amount information that is information for estimating an amount of the ink in an ink holding unit. The processing unit is configured to be capable of executing, in a state where the memory unit is attached to the slot, a charging process that updates the estimated ink amount information using the permitted usage amount information in the memory unit on the basis of a process for determining whether or not a consumed ink amount expressed by the estimated ink amount information exceeds a prescribed threshold, and is configured to be capable of executing a forced charging process that executes the charging process in the case where there is an instruction from an operator before the prescribed threshold is exceeded.

According to the configuration of this application example, in the case where the memory unit is attached to the slot, the charging process is executed on the basis of a determination result using the prescribed threshold. This makes it possible to realize continuous printing operations. Furthermore, even before the consumed ink amount expressed by the estimated ink amount information (called an "estimated consumed ink amount" hereinafter) exceeds the prescribed threshold, the forced charging process can be executed in the case where there is an instruction from an operator of the printing apparatus. As such, in the case where an actual amount of ink consumed by the printing apparatus (called an "actual consumed ink amount" hereinafter) has progressed further than the estimated consumed ink amount, the estimated consumed ink amount and the actual consumed ink amount can be associated with each other by executing the forced charging process. As a result, in the case where an error has occurred in which the actual consumed ink amount will be greater than the estimated consumed ink amount based on the permitted usage amount information of the ink stored in the memory unit, that error can be reduced and the subsequent charging processes can be executed at the times when it is necessary to refill the ink.

Here, the "operator" is a general user of the printing apparatus, a maintenance worker of the printing apparatus who carries out maintenance on the printing apparatus (for example, a service worker for the printing apparatus vendor or the like), or the like.

Application Example 2

In the printing apparatus according to the aforementioned application example, it is preferable that in the case where the instruction has been inputted from a menu for a user of the printing apparatus, the processing unit is configured to be capable of executing the forced charging process when the consumed ink amount is greater than or equal to a predetermined value that is lower than the prescribed threshold.

According to the configuration of this application example, in the case where an operator of the printing apparatus has inputted the instruction from the menu for a user, the forced charging process can be executed when the estimated consumed ink amount is greater than or equal to the predetermined value that is lower than the prescribed threshold. This makes it possible to prevent a situation in which the operator executes the forced charging carelessly and the estimated consumed ink amount cannot be completely consumed despite the estimated consumed ink amount based on the permitted usage amount information of the ink stored in the memory unit being present.

Application Example 3

It is preferable that the printing apparatus according to the aforementioned application examples further include a user interface unit, and that the processing unit display the menu in the user interface unit.

According to the configuration of this application example, a user interface unit that displays the menu for the user of the printing apparatus (a menu for normal operations of the printing apparatus) is included. Accordingly, the user can make the instruction for executing the forced charging from the menu displayed in the user interface unit.

Application Example 4

In the printing apparatus according to the aforementioned application examples, it is preferable that the processing unit display a state of the consumed ink amount of the memory unit in the user interface unit.

According to the configuration of this application example, the state of the estimated consumed ink amount based on the permitted usage amount information of the ink stored in the memory unit is displayed in the user interface unit. As such, the user can easily confirm the estimated consumed ink amount in the user interface unit.

Application Example 5

In the printing apparatus according to the aforementioned application examples, it is preferable that the processing unit is configured to be capable of executing the forced charging process regardless of a value of the consumed ink amount in the case where the instruction has been inputted from a maintenance menu of the printing apparatus.

According to the configuration of this application example, in the case where an operator of the printing apparatus has inputted the instruction from the maintenance menu, the forced charging process can be executed regardless of the value of the estimated consumed ink amount. As such, when performing maintenance on the printing apparatus, the forced charging process can be executed without being restricted by the value of the estimated consumed ink amount. Additionally, because the maintenance menu is prepared separately from the menu for the user (that is, the menu for normal operations of the printing apparatus), a situation in which a general user carelessly executed the forced charging can be prevented.

Application Example 6

It is preferable that the printing apparatus according to the aforementioned application examples further include a storage unit, and that, in the case where the forced charging process has been executed in response to an instruction from the maintenance menu, the processing unit store information enabling a day on which the forced charging process was executed to be specified in the storage unit.

According to the configuration of this application example, in the case where the forced charging process has been executed in response to an instruction from the maintenance menu, the processing unit stores information enabling the day on which the forced charging process was executed to be specified in the storage unit. As such, the day on which maintenance was carried out can be specified by the information stored in the storage unit. This makes it possible to track and investigate cases such as where a user aside from a maintenance worker misused the printing apparatus, where a problem occurred in the printing apparatus, and the like, for example.

Application Example 7

In the printing apparatus according to the aforementioned application examples, it is preferable that the processing unit be configured to be capable of executing a setting of the prescribed threshold so as to delay a period in which the charging process is executed.

According to the configuration of this application example, the prescribed threshold can be set so that the period in which to execute the charging process is delayed. Accordingly, in the case where the estimated consumed ink amount has progressed further than the actual consumed ink amount, such as a case where clogging has occurred, the estimated consumed ink amount can be associated with the actual consumed ink amount by delaying the period in which the charging process is executed using the update period extension. As a result, in the case where an error has occurred in which the actual consumed ink amount will be lower than the estimated consumed ink amount based on the permitted usage amount information of the ink stored in the memory unit, that error can be reduced and the subsequent charging processes can be executed at the times when it is necessary to refill the ink.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment will be described hereinafter. Note that the embodiment described hereinafter is not intended to limit the invention as described in the claims in any way. Furthermore, it is not necessarily the case that all of the elements described in the embodiment are requisite elements of the invention.

1. Technique According to Embodiment

Figure 6:
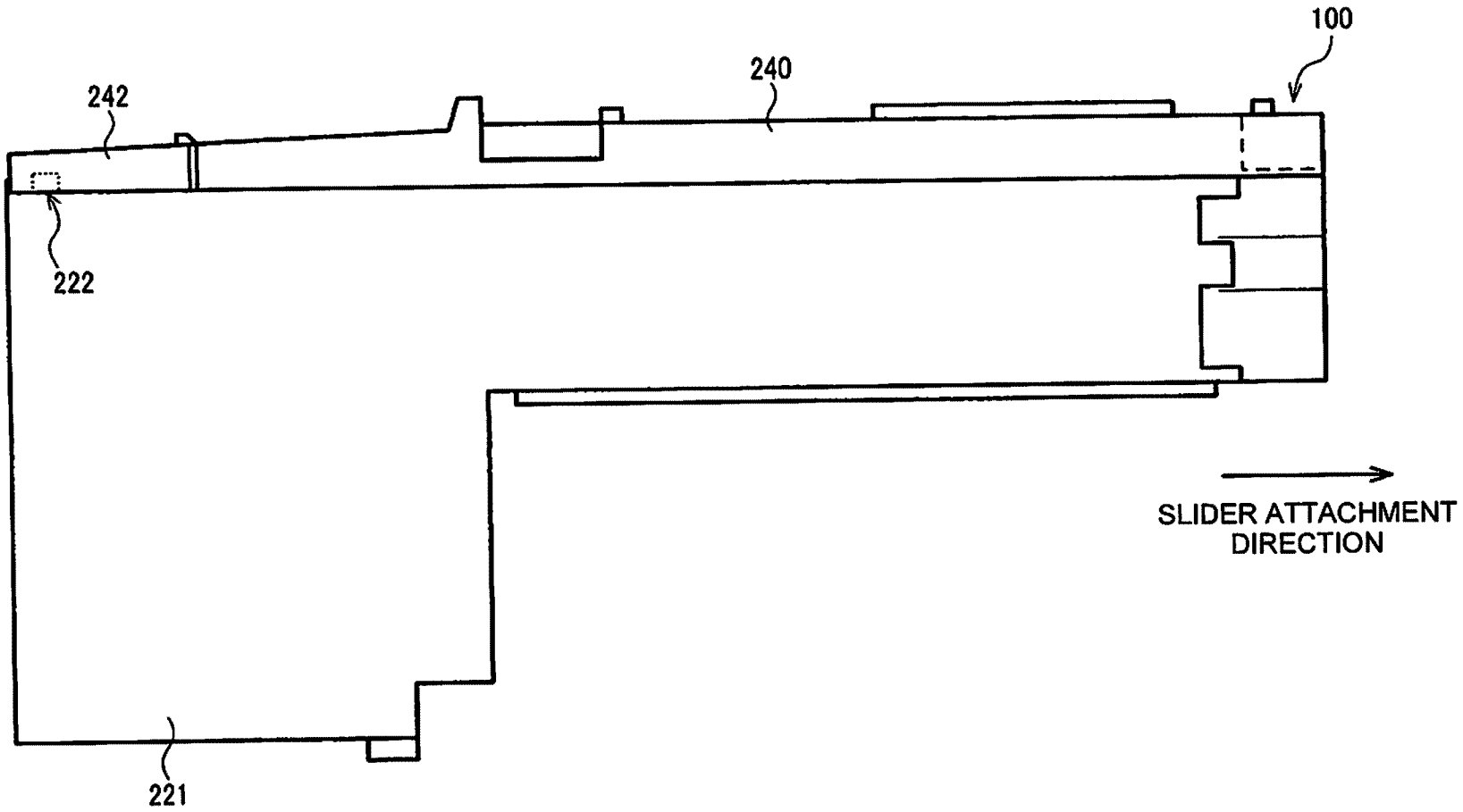
FIG. 6 is a side view illustrating an example of the configuration of an ink tank and a slider according to the embodiment.

First, a technique according to the embodiment will be described in comparison to past techniques. Printing apparatuses that carry out a counting process (soft counting process) that counts a cumulative value of an amount of ink consumed while the printing apparatus is operating and find an estimated consumed ink amount for ink within an ink tank are widely known. Furthermore, printing apparatuses in which an ink refilling receptacle (ink pack 310) filled with ink and a memory unit 100 that stores information regarding the ink with which the ink refilling receptacle has been filled, such as information of the color, volume, and the like of the ink, are provided to a typical user of the printing apparatus as separate units are widely known, as illustrated in FIG. 6 of JP-A-2014-46545.

In printing apparatuses, managing the amount of ink remaining in an ink holding unit is extremely important for carrying out printing processes correctly, and a consumed ink amount found through a counting process may be used in this management. To be more specific, an amount of ink permitted to be used is defined by permitted usage amount information stored in the memory unit 100, and printing operations are carried out until it is determined that the amount of ink defined by the permitted usage amount information has been consumed. In the case where it has been determined that the amount of ink defined by the permitted usage amount information has been consumed, the user may be instructed to refill the ink, the printing operations may be stopped, or the like.

However, in the case where the ink pack 310 and the memory unit 100 are separate units, the timing at which the ink holding unit (ink tank) of the printing apparatus is refilled with ink from the ink pack 310 and the timing at which the memory unit 100 is attached to the printing apparatus will not necessarily match. Accordingly, the amount of ink determined to be usable on the printing apparatus main unit (called simply a "main unit" hereinafter) side may differ from the actual amount of ink in the ink tank.

JP-A-2014-46545 discloses a technique presuming management for suppressing such a difference. Specifically, the consumed ink amount is managed by reading and writing total consumed ink amount information each time a difference in consumed ink amounts exceeds WTH1 in order to ensure the total consumed ink amount information is compatible between the memory unit 100 and the printing apparatus main unit. With the technique according to JP-A-2014-46545, a user can use the printing apparatus through the following usage method: (1) the ink is refilled from the ink pack 310, and the memory unit 100 is attached; (2) printing is carried out, while writing the total consumed ink amount into the memory unit, until the total consumed ink amount on the main unit side reaches or exceeds WTH2; and (3) the process returns to (1) when the total consumed ink amount is less than WTH3 but greater than or equal to WTH2, where the ink is refilled from a new ink pack 310 supplied by a vendor, a new memory unit 100 included with the ink pack 310 is attached, and the main unit-side total consumed ink amount is overwritten with a memory unit-side total consumed ink amount from the memory unit 100.

However, investigations by the applicants for this application revealed that actual usage situations differ from that described above. As disclosed in JP-A-2014-46545, the printing apparatus executes printing operations under the condition that a new, valid memory unit 100 has been attached. Accordingly, if the memory unit 100 is not properly attached, the printing cannot be executed even if the ink tank is filled with ink from the ink pack 310.

Although not a preferred usage method, printing operations can be carried out in some form even when the ink the ink tank is actually filled with is not ink supplied by the printing apparatus vendor (that is, is not ink supplied as part of an ink pack set 300), as long as there is a valid memory unit 100. In the case where ink supplied by the vendor is not used, the memory unit 100 in the ink pack set 300 is relatively expensive, whereas the ink pack 310 is relatively cheap.

The result is that differences arise between the ways in which the memory unit 100 and the ink pack 310 are managed. For example, in the case where the printing apparatus is to be used in a factory, the users of the printing apparatus are an administrator and an ordinary worker working under the administrator. Because the ink pack 310 does not require strict management, an ordinary worker can handle the ink pack 310 without restrictions, and can therefore refill the ink in the ink tank at the appropriate time. As opposed to this, the memory unit 100 is managed by the administrator.

In such a case, the ink tank can be refilled with the ink held in the ink pack 310 at any time as long as the ink does not overflow from the ink tank, but the memory unit 100 can only be attached during the limited amount of time when the administrator is working. Although inks contained in ink packs 310 have risen to such high volumes as 1 L, printing apparatuses themselves have increased in size as well, and thus printing can only be carried out continuously for approximately 12 hours, for example, even if the ink tank is filled with all of the ink from the ink pack 310. As such, in the case where a management system such as that described above is employed, it is necessary for a small number of administrators to attach the memory unit 100 to the printing apparatus at least every 12 hours, which increases the burden on users when using the printing apparatus to print continuously.

As described above, according to the technique disclosed in JP-A-2014-46545, when printing continuously, the timing at which the memory unit 100 is replaced is restricted. As a result, there is a problem in that continuous printing is burdensome for users or is simply difficult to carry out.

In response to such an issue, a technique can be considered in which when a memory card or a separate memory is attached, a volume (ink volume) stored in the memory card or separate memory is added to a liquid stock amount on the main unit side, as disclosed in JP-A-2008-254395, JP-A-2011-73208, or the like. According to JP-A-2008-254395 and JP-A-2011-73208, the information in the memory card or separate memory is moved to the main unit side, and thus printing operations can continue even after the memory card or separate memory is removed from the printing apparatus. Furthermore, even in the case where a plurality of memory cards or separate memories have been attached, the volume in each memory is added on the main unit side and managed, and thus continuous printing is possible thereafter for a relatively long period of time even if a new memory is not mounted.

However, according to JP-A-2008-254395 or JP-A-2011-73208, it is conceivable that the memory card or separate memory from which the stored volume has been added to the liquid stock amount on the main unit side has been set to an invalid state. This is because not doing so would enable a single memory card or separate memory to be used repeatedly, which is unreasonable. Accordingly, it is assumed that memory cards or separate memories whose volumes have been added to the main unit side will not be used thereafter, and information regarding the amount of ink actually consumed relative to the volume stored in the memory card or separate memory cannot be held.

As a result, in the case where an error occurs on the main unit side and information of the liquid stock amount managed on the main unit side has been lost, information indicating how much volume has been added and how much of that volume has been consumed cannot be recovered. If the usable ink amount is set to 0 after the printing apparatus is restored (repaired), a user who has only used some of the ink corresponding to the volume stored in the memory card or separate memory may be adversely affected. However, setting the liquid stock amount to the total amount of the volume stored in the memory card or separate memory (or to the maximum value that can be added on the main unit side) instead may compensate the user excessively. In other words, the techniques according to JP-A-2008-254395 and JP-A-2011-73208 have a problem in that it is difficult to respond appropriately when a malfunction occurs.

Figure 1:
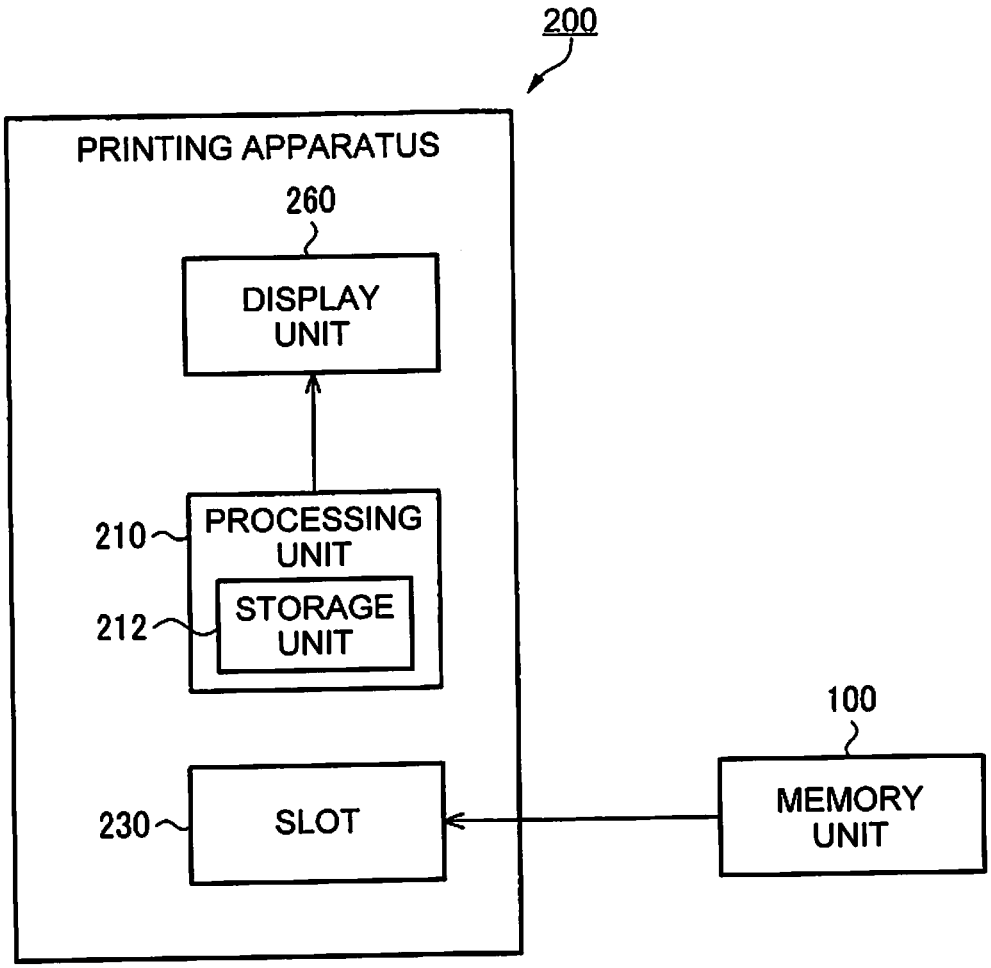
FIG. 1 is a diagram illustrating an example of the system configuration of a printing apparatus according to an embodiment of the invention.

The system configuration of a printing apparatus 200 according to this embodiment will be described hereinafter. FIG. 1 is a diagram illustrating an example of the system configuration of the printing apparatus 200 according to this embodiment. As illustrated in FIG. 1, the printing apparatus 200 according to this embodiment includes a slot 230 to and from which a memory unit 100 can be attached and removed, and a processing unit 210. The memory unit 100 stores permitted usage amount information of the ink (information based on an amount of ink with which an ink refill receptacle, which will be mentioned later, has been filled). The processing unit 210 carries out a process for updating estimated ink amount information (information indicating an estimated amount of ink within an ink holding unit 220), which is information for estimating the amount of ink in the ink holding unit 220 (see FIG. 2).

While the memory unit 100 is attached to the slot 230, the processing unit 210 carries out a charging process for updating the estimated ink amount information using the permitted usage amount information from the memory unit 100 on the basis of a process for determining whether or not a consumed ink amount expressed by the estimated ink amount information (called an "estimated consumed ink amount" hereinafter) exceeds a prescribed threshold WTH. Furthermore, the processing unit 210 carries out a setting process for making the prescribed threshold WTH variable.

Here, the permitted usage amount information is information stored in the memory unit 100, and is information expressing an amount of ink the user who holds that memory unit 100 is permitted to use (a permitted usage amount). More specifically, the permitted usage amount information is stored as information of an initial fill amount of ink held in an ink pack 310 (see FIG. 10) with which the memory unit 100 is included and a consumed ink amount indicating an amount already consumed relative to that initial fill amount. The consumed ink amount is stored as data indicating a percentage of ink consumed relative to the initial fill amount of the ink. 0% is stored as the permitted usage amount information and the consumed ink amount at the point in time when the user purchases an ink pack set 300 (see FIG. 10).

By purchasing the ink pack set 300, the user purchases the right to use only the ink contained in the ink pack 310, and the printing apparatus 200 executes a process for continuing/stopping printing operations of the printing apparatus 200 using the permitted usage amount information from the memory unit 100.

Meanwhile, the estimated ink amount information is information for estimating the amount of ink in the ink holding unit 220, and is stored in a rewritable and non-volatile manner in a storage unit 212 of the printing apparatus 200. In this embodiment, the estimated ink amount information is expressed by the consumed ink amount; here, the consumed ink amount is a percentage of the estimated consumed ink amount, indicating the total amount of ink consumed (also called "main unit-side total consumed ink amount information WD"), relative to the initial fill amount read out from the attached memory unit 100. As will be described later, the main unit-side total consumed ink amount information WD is replaced with the consumed ink amount from the memory unit 100 in the charging process carried out when the memory unit 100 is attached. The processing unit 210 of the printing apparatus 200 controls the continuing/stopping of the operations of the printing apparatus 200 on the basis of the estimated ink amount information.

In other words, the estimated ink amount information is expressed as information indicating an amount of ink consumed relative to a usable ink amount (permitted usage amount; initial fill amount). The amount of ink consumed after the memory unit 100 has been attached and the main unit has been charged with the permitted usage amount information from the memory unit 100 is counted, and information expressing what percent of the initial fill amount the estimated consumed ink amount found through the counting process represents is taken as the main unit-side total consumed ink amount information WD.

The total consumed ink amount information WD can be expressed, for example, as a relative value (0-100%), with the amount of ink held in the ink pack 310 (here, the capacity of the ink pack 310 is assumed to be 1 L) representing 100%. The processing unit 210 reads out the initial fill amount of the ink pack 310 from the memory unit 100, calculates the relative value from the initial fill amount and the amount of ink consumed, and takes the result of that calculation as the estimated consumed ink amount.

However, an actual printing apparatus 200 is used under a variety of conditions depending on the user, and there is thus an allowance with respect to the ink consumption efficiency (printing efficiency). In other words, there are printing apparatuses 200 used under conditions where the actual amount of ink consumed (called an "actual consumed ink amount" hereinafter) is comparatively high or printing apparatuses 200 used under conditions where the actual consumed ink amount is comparatively low, and thus there are cases where the actual consumed ink amount (the amount of ink actually consumed) and the estimated consumed ink amount found through the counting process do not match even when printing processes are carried out using the same print data.

Accordingly, this embodiment assumes a case in which a printing apparatus 200 whose ink consumption efficiency is a lower limit value of a predetermined range (that is, a printing apparatus having the highest actual consumed ink amount) is used in a usage environment recommended by the vendor of the printing apparatus, and expresses the estimated consumed ink amount as a relative value, using the consumed ink amount estimated for when the ink held in the ink pack 310 is consumed as 100%.

Doing so makes it possible even for a printing apparatus 200 having the worst ink consumption efficiency to print up to 100%, and a process for displaying a message prompting the user to refill the ink can be carried out upon 100% being reached.

Such being the case, when a printing apparatus 200 having a standard ink consumption efficiency is used in a standard environment, the consumed ink amount for when the amount of ink contained in the ink pack 310 is actually consumed (a consumed ink amount percentage) will be greater than 100%, for example, 117%. The vendor of the printing apparatus stores the total consumed ink amount information WD for when all of the ink contained in the ink pack 310 has been consumed by the printing apparatus 200 having a standard ink consumption efficiency (117%, here) in the storage unit 212 of the processing unit 210 in advance. The processing unit 210 calculates the total consumed ink amount information WD from this value, the initial fill amount (expressed in units of weight) read out from the memory unit 100, and a total consumed ink amount (expressed in units of weight), and stores the calculated information in the storage unit 212.

Although the ink pack 310 is a 1 L ink pack, there may be slight variations in the amount contained therein from ink pack 310 to ink pack 310. However, variations in the initial fill amounts stored as the initial fill amounts in the memory units 100 of the ink packs 310 are small compared to variations in the ink consumption efficiency, and thus the total consumed ink amount information WD may be calculated assuming that the total consumed ink amount information WD set in advance by the vendor for when all of the 1 L of ink contained in the ink pack 310 has been consumed by the printing apparatus 200 having a standard ink consumption efficiency (that is, 117%) corresponds to the initial fill amount.

However, rather than storing a percentage of the main unit-side consumed ink amount itself, the initial fill amount and a weight of the total consumed ink amount may be stored on the main unit side as the estimated ink amount information. In this case, the processing unit 210 may calculate the main unit-side consumed ink amount percentage as appropriate on the basis of this information as the total consumed ink amount information WD.

The charging process according to this embodiment is a process in which a process for updating the total consumed ink amount information WD (estimated consumed ink amount) of the main unit-side estimated ink amount information on the basis of the consumed ink amount in the permitted usage amount information stored in the memory unit 100 attached to the slot 230 is carried out, and the initial fill amount stored in the memory unit 100 is set in the storage unit 212 as information with which the main unit-side processing unit 210 calculates the total consumed ink amount information WD.

Note that in the case where the main unit-side estimated ink amount information and the permitted usage amount information in the memory unit 100 have the same format, as is the case in this embodiment, the estimated consumed ink amount of the estimated ink amount information may simply be replaced with the consumed ink amount in the permitted usage amount information in the updating process. However, in the case where the estimated ink amount information and the permitted usage amount information have different formats, such as a case where the memory unit 100 stores a percentage and the main unit stores an actual amount of ink that has been consumed, a process for replacing the estimated ink amount information may be carried out on the basis of a result of carrying out some kind of conversion process on the permitted usage amount information. "Replace" refers to a process that also includes post-conversion replacement in this embodiment.

According to the technique of this embodiment, first, upon the memory unit 100 being attached, the charging process for updating (replacing) the estimated ink amount information is carried out on the basis of the permitted usage amount information from that memory unit 100.

At this time, whether or not to carry out the charging process is determined on the basis of a determination process that uses the prescribed threshold WTH. The memory unit 100 is invalidated in the case where the charging process has been carried out, making it impossible to reuse the memory unit 100. For a user who uses many printing apparatuses 200, it is conceivable that the user cannot estimate how much printing he or she has carried out with which printing apparatus 200 in advance. In such a case, the user will want to move the permitted usage amount information charged for a given printing apparatus 200 to another printing apparatus 200. In such a case, according to the techniques disclosed in JP-A-2008-254395 and JP-A-2011-73208, the charged memory unit 100 cannot be reused, and thus it is necessary to realize a method for exchanging the charged permitted usage amount information (estimated ink amount information) between the printing apparatuses 200.

With respect to this point, in this embodiment, a threshold determination as to whether or not the estimated consumed ink amount of the main unit-side estimated ink amount information exceeds a predetermined threshold is a condition of the charging process. Accordingly, processing in which a prescribed memory unit 100 is attached to the slot 230 but the charging process is not carried out is also possible, depending on the main unit-side estimated consumed ink amount, and in such a case, the memory unit 100 can be removed from the slot 230 and reused.

As is clear from the foregoing, the prescribed threshold WTH in this embodiment serves as an important parameter for determining whether or not to invalidate the memory unit 100 attached to the slot 230, or in other words, whether to keep the memory unit 100 in a reusable state or make the memory unit 100 unable to be reused. With the technique according to this embodiment, the prescribed threshold WTH can be set variably, and thus appropriate processing corresponding to the circumstances can be carried out.

Note that printing operations cannot be carried out in an uncharged state in which no charging process has been carried out (that is, a state in which the estimated consumed ink amount exceeds the prescribed threshold (WTH)), and thus the charging process is executed without carrying out the threshold determination in the case where the memory unit 100 is attached to the slot 230 while in the uncharged state.

Then, in the case where after the charging process carried out on the basis of the memory unit 100 (a first memory unit 100-1), a new memory unit 100 (a second memory unit 100-2) is attached to the slot 230, the processing unit 210 according to this embodiment does not carry out the charging process on the basis of the second memory unit 100-2 until the estimated consumed ink amount exceeds the prescribed threshold (WTH). In this case, the processing unit 210 carries out the charging process using the second memory unit 100-2 when the estimated consumed ink amount has exceeded the prescribed threshold.

Figure 2:
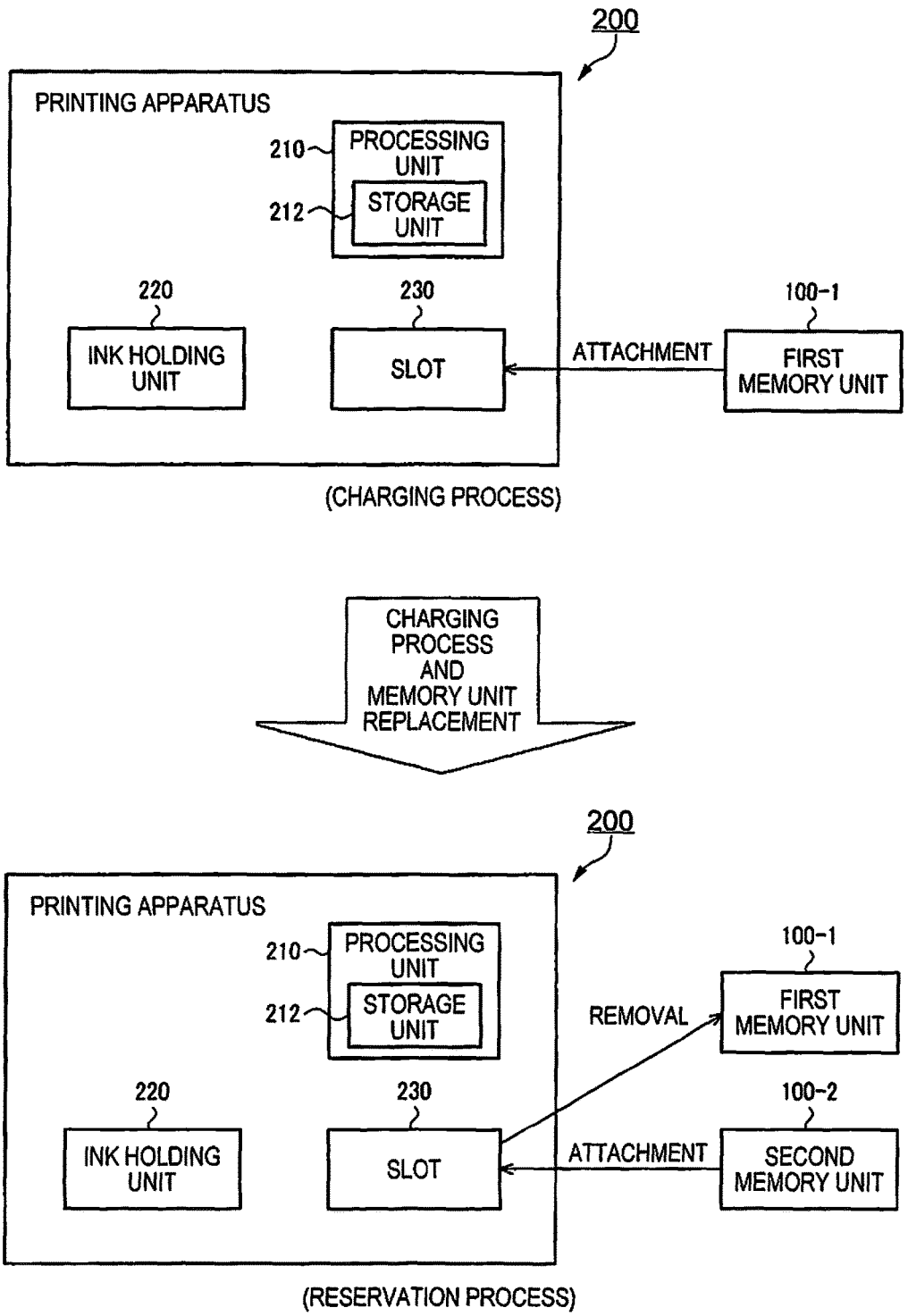
FIG. 2 is a schematic diagram illustrating the flow of a charging process and a reservation process using two memory units.

FIG. 2 is a schematic diagram illustrating the flow of the charging process and a reservation process using the two memory units 100. First, upon the first memory unit 100-1 being attached to the slot 230 in a state where the charging process has not been carried out, the charging process for updating the estimated ink amount information stored in the storage unit 212 of the printing apparatus 200 is executed on the basis of the permitted usage amount information from the first memory unit 100-1. After the charging process, printing operations can be carried out without the ink-consuming operations of the printing apparatus 200 being affected, even if the first memory unit 100-1 is removed.

Next, upon the second memory unit 100-2 being attached to the slot 230 while the printing apparatus 200 is carrying out ink-consuming operations based on the permitted usage amount information from the first memory unit 100-1, the processing unit 210 executes a reservation process for putting the second memory unit 100-2 into a reserved state. In other words, the user of the printing apparatus 200 can implement the charging process, the reservation process, and so on by attaching or removing the memory units 100 to or from the slot 230 as appropriate.

Note that in the case where the first memory unit 100-1 is attached while the ink-consuming operations based on the permitted usage amount information from the first memory unit 100-1 are being executed, the consumed ink amount in the first memory unit 100-1 may be updated so as to synchronize the consumed ink amount in the first memory unit 100-1 with the total consumed ink amount stored in the storage unit 212.

Here, even if the second memory unit 100-2 is attached, the charging process will not be carried out until the total consumed ink amount information WD in the estimated ink amount information for the main unit exceeds the prescribed threshold WTH (this corresponds to the permitted usage amount information). As such, even if the main unit-side storage unit 212 malfunctions or the like and an error occurs in the main unit-side estimated ink amount information, only the permitted usage amount information from the first memory unit 100-1 will be lost, and the second memory unit 100-2 will not be affected. In other words, prior to the charging process, the second memory unit 100-2 is still in a usable state, and is not affected by the malfunction.

Additionally, if the total consumed ink amount information WD exceeds the prescribed threshold, the processing unit 210 of the printing apparatus 200 automatically executes the charging process for the second memory unit 100-2 without an instruction from the user. This automatically-executed charging process is an automatic switch from ink-consuming operations of the printing apparatus 200 based on the permitted usage amount information from the first memory unit 100-1 to ink-consuming operations of the printing apparatus 200 based on the permitted usage amount information from the second memory unit 100-2, and will also be referred to as "automatic charging" in this specification hereinafter. In this manner, if the second memory unit 100-2 is attached to the slot 230, the charging process will be executed automatically even without user participation, which is advantageous for the user in that the timing for attaching the second memory unit 100-2 is not restricted.

Attaching the second memory unit 100-2 prior to the total consumed ink amount information WD charged using the first memory unit 100-1 exceeding the prescribed threshold WTH can be thought of as reserving the charging process, in the sense that the charging process is subject to execution once the conditions thereof are met. As such, in the specification hereinafter, the second memory unit 100-2 attached prior to the total consumed ink amount information WD in the estimated ink amount information charged using the first memory unit 100-1 exceeding the prescribed threshold WTH will be referred to as being in a "reserved state", and the processing executed by the processing unit 210 for putting the second memory unit 100-2 in the reserved state will be referred to as a "reservation process".

In this embodiment, an amount of ink corresponding to two pieces of permitted usage amount information, namely one from the memory unit 100 already subjected to the charging process and one from the memory unit 100 in the reserved state, can be used continuously. As such, filling the ink holding unit 220 with ink as appropriate makes it possible to print continuously for a longer amount of time (24 hours, for example) than the usage time provided by a single memory unit 100.

In light of the reservation process executed using the second memory unit 100-2 and the automatic charging process that follow the charging process executed using the first memory unit 100-1, it is preferable that the prescribed threshold WTH be set to a value that enables the user to use a permitted usage amount corresponding to the permitted usage amount information of the first memory unit 100-1 without running out. Doing so makes it possible to suppress improper usage, such as the user not using up the ink amount corresponding to the first memory unit 100-1 (the permitted usage amount; in an unused state, the initial fill amount) or the user being allowed to use an amount of ink far exceeding the stated ink amount. In other words, it is preferable that the prescribed threshold WTH be set to a value expressing the permitted usage amount or a value having a prescribed margin added thereto. For example, if the total consumed ink amount information WD corresponding to the permitted usage amount is 117% as described above, a value from 117% to 120% may be used.

However, it is undeniable that in the case where error arises between the estimated consumed ink amount counted in the counting process and the actual consumed ink amount, the automatic charging may be carried out at an improper timing.

For example, in the case where the printing apparatus 200 is used in an environment where the temperature is higher than a suitable temperature range, the amount of ink consumed (ejected) by a single ink ejection will be greater than in the case where the printing apparatus 200 is used in the suitable temperature range. In this case, the actual consumed ink amount is greater than the estimated consumed ink amount estimated through the counting process, and thus in a state where the estimated consumed ink amount has reached the prescribed threshold WTH, a greater amount of ink than the initial fill amount (1 L, in the example described above) is actually consumed.

Although the timing at which the automatic charging serves as a guideline for the user to refill the ink, a greater amount of ink than the initial fill amount will be consumed by the time the automatic charging is carried out in the above-described example. Thus depending on the situation, there is a risk that the ink in the ink holding unit 220 will be exhausted and printing operations will stop before the ink is refilled by the user. For such a user, the prescribed threshold WTH may be lowered and the automatic charging executed comparatively early. For example, WTH is set to 110%.

On the other hand, in the case where the printing apparatus 200 is used in an environment where the temperature is lower than a suitable temperature range, a case where ink has clogged a head or an ink flow channel from the ink holding unit 220 to the head, or the like, the amount of ink consumed (ejected) by predetermined number of ink ejections will be lower than when printing in a normal state, and depending on the situation, may reach 0 before the head can be cleaned.

In this case, the actual consumed ink amount will be lower than the estimated consumed ink amount estimated through the counting process, and thus the initial fill amount of ink will not be completely consumed in a state where the estimated consumed ink amount has reached the prescribed threshold WTH. As a result, despite having correctly obtained the right to use the amount of ink corresponding to the permitted usage amount information, the user will only be able to use a lower amount of ink. For such a user, the prescribed threshold WTH may be raised and the automatic charging executed comparatively late. For example, WTH is set to 130%.

Next, an example of the configurations of the printing apparatus 200 and the memory unit 100 will be described.

2. Example of Configurations of Printing Apparatus and Memory Unit

Figure 3:
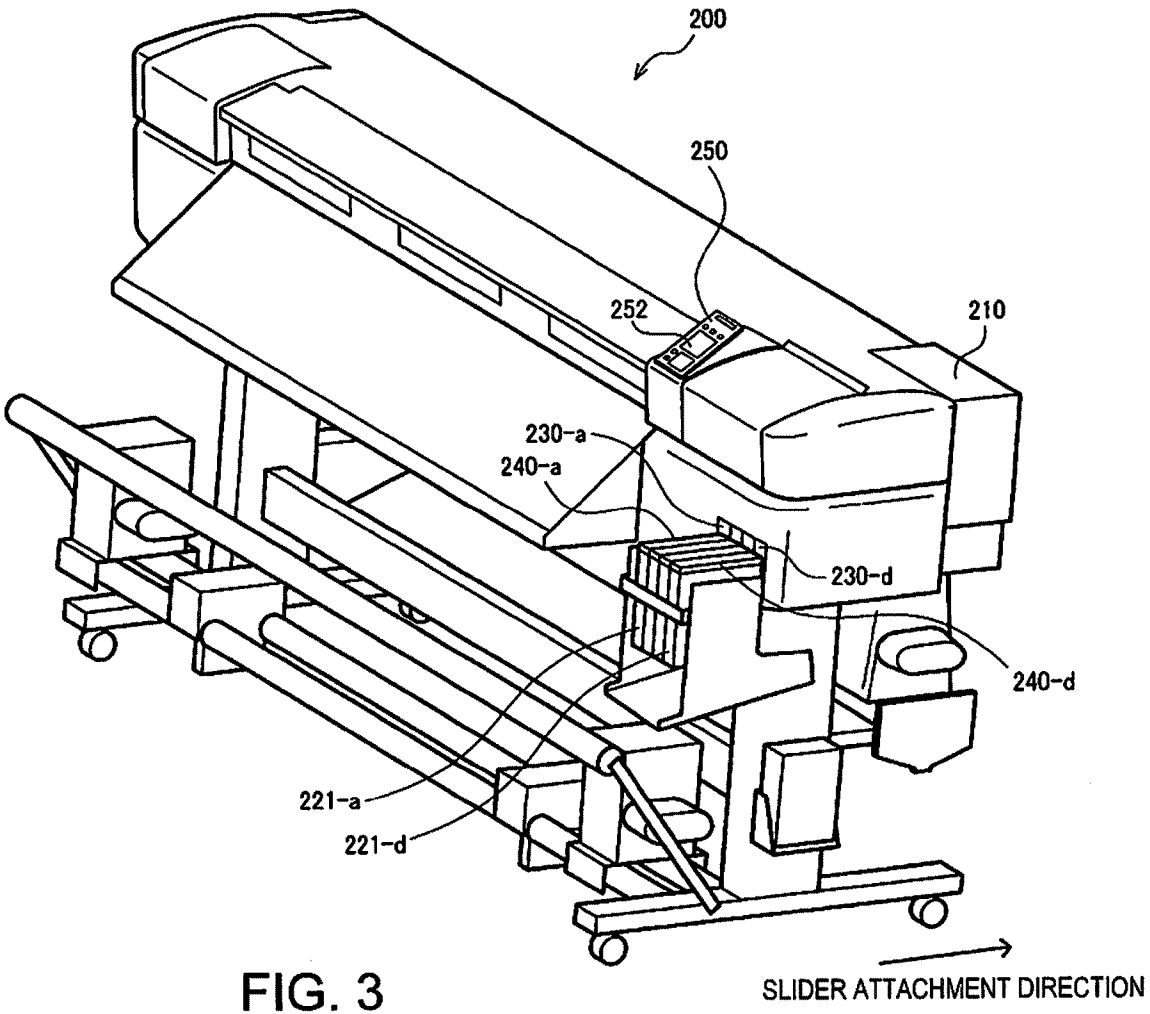
FIG. 3 is a perspective view illustrating an example of the configuration of the printing apparatus according to the embodiment.
Figure 4:
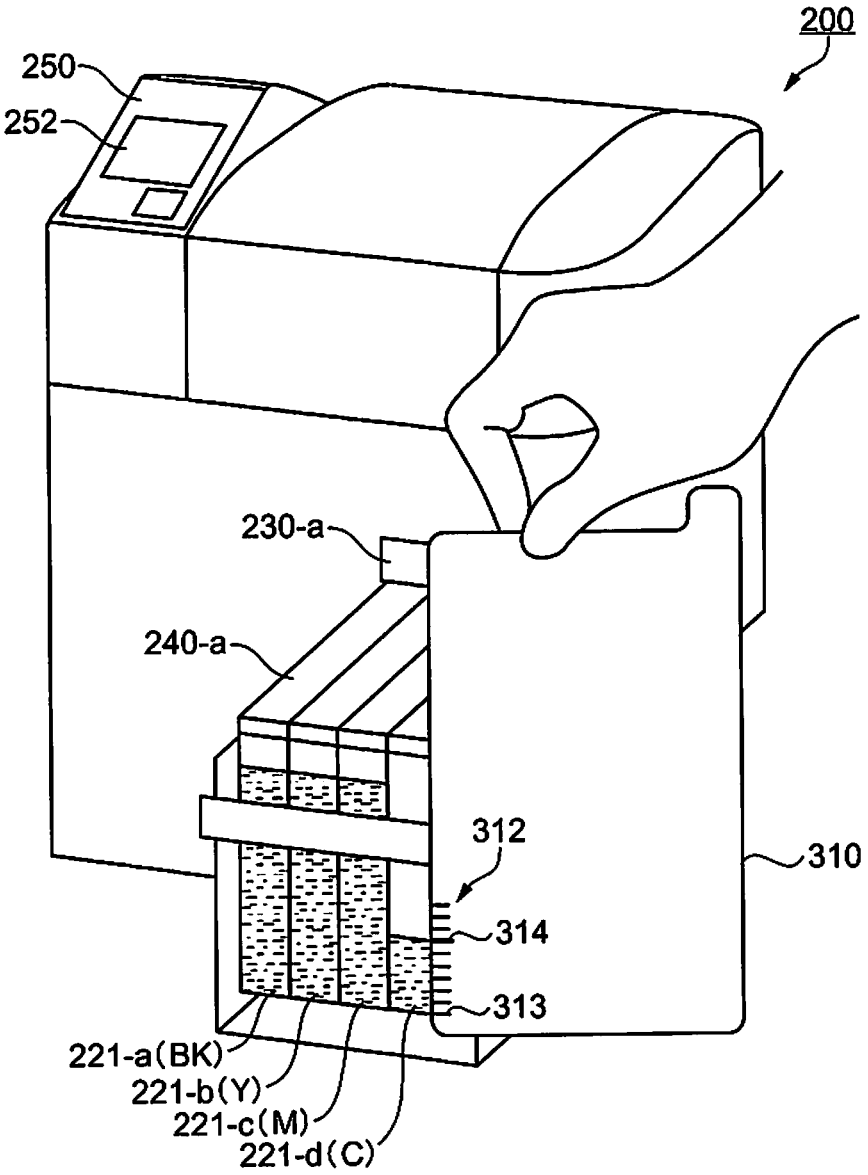
FIG. 4 is a diagram illustrating the vicinity of ink tanks of the printing apparatus in an enlarged manner.

FIG. 3 is a perspective view illustrating an example of the configuration of the printing apparatus 200 according to this embodiment. FIG. 4 is a diagram illustrating the vicinity of ink tanks 221 of the printing apparatus 200 in an enlarged manner. As illustrated in FIG. 3, the printing apparatus 200 according to this embodiment includes: four ink tanks 221-*a* to 221-*d* serving as ink holding units 220; a plurality of (four) slots 230-*a* to 230-*d*; four memory units 100-*a* to 100-*d* (see FIG. 11); four sliders 240-*a* to 240-*d*; the processing unit 210; a console unit 250; and a printing execution unit (not shown) that includes a print head. Although there are four ink tanks 221 in this embodiment, the number is not limited thereto, and there may be two or three ink tanks 221, or five or more.

Note that in the following descriptions, the four ink tanks 221-*a* to 221-*d* will be referred to as ink tanks 221 as appropriate when it is not necessary to distinguish between individual ink tanks. The same applies to the slots 230-*a* to 230-*d*, the memory units 100-*a* to 100-*d*, and the sliders 240-*a* to 240-*d*.

The four ink tanks 221-*a* to 221-*d* are filled with ink contained in corresponding ink packs 310 (see FIG. 4) supplied by the vendor of the printing apparatus. For example, as illustrated in FIG. 4, the ink tank 221-*a* is filled with black (BK) ink, the ink tank 221-*b* with yellow (Y) ink, the ink tank 221-*c* with magenta (M) ink, and the ink tank 221-*d* with cyan (C) ink. These inks are contained in separate ink packs 310, which are then supplied to the user. The user can fill (refill) the ink tank 221 corresponding to a needed color from the ink pack 310 for that color.

With the ink tanks 221, the amount of ink within the ink tanks can be seen by the user. For example, as illustrated in FIG. 3, a configuration in which the ink within the ink tanks 221 can be seen is achieved by making the ink tanks 221 at least partially exposed to the exterior so as to be visible to the user and forming the parts visible to the user from transparent members.

A lower limit line (not shown) may be provided on the ink tanks 221. The lower limit line is a line-shaped mark provided in the horizontal direction on the surface of the ink tank 221 from which the ink therein can be seen, and is provided at a position 7 cm from the bottom surface of the ink tank 221, for example. If the ink amount has dropped as far as the lower limit line (that is, if a surface of the ink has dropped as far as the position of the lower limit line), the ink tank can be filled with all of the ink in the ink pack 310. The user can refill the ink as appropriate even during printing by visually confirming the relationship between the ink amount and the lower limit line.

Alternatively, a scale 312 including a lower limit line 314 may be printed on a front surface of the ink pack 310, as indicated in FIG. 4, instead of providing the lower limit line on the ink tank 221. In this case, the user can confirm whether or not the ink surface has dropped as far as the position of the lower limit line 314 by placing the ink pack 310 against the ink tank 221 so that a reference line 313 in the scale 312 is positioned at the bottom surface of the ink tank 221.

The printing apparatus 200 includes the console unit 250. The console unit 250 is an input device through which the user makes various types of instructions, settings, and the like, and includes a user interface unit ("UI unit" hereinafter) 252, operating buttons, and the like. The UI unit 252 can display information regarding ink refilling to the user, menus that can be selected by the user, and the like, and can also accept operation inputs from the user.

Accordingly, the user can refill the ink tank 221 with ink from the ink pack 310 while checking the UI unit 252 of the printing apparatus 200 and the ink in the ink tank 221. While there are cases where the user visually confirms that the ink surface has fallen below the lower limit line and refills the ink, a case where the user receives a warning from the UI unit 252 and refills the ink is also conceivable. If the ink is to be refilled at an appropriate timing in accordance with the actual ink consumption conditions, it is desirable that the ink tank 221 be refilled with ink when the ink surface has been visually confirmed to have reached the lower limit line.

A sensor (not shown) that detects the presence/absence of ink is present in a flow channel between the ink tank 221 and the print head, and the printing apparatus 200 always stops operations when the sensor detects that there is no ink, regardless of the value of the total consumed ink amount information WD in the main unit. Accordingly, even if the user forgets to refill the ink tank with ink, malfunctions in the head caused by blank printing by the head (ink ejection operations being carried out in a state where there is no ink in the head) can be prevented. However, if the ink is refilled at the appropriate timing, the printing apparatus 200 can continue printing operations without the operations stopping due to the sensor detecting that no ink is present.

The plurality of slots 230-*a* to 230-*d* are for attaching the sliders 240-*a* to 240-*d*, which can be attached to and removed from the printing apparatus 200, to the printing apparatus 200, and are provided corresponding to the aforementioned ink tanks 221-*a* to 221-*d*. For example, the four slots 230-*a* to 230-*d* are provided above the corresponding black, yellow, magenta, and cyan ink tanks 221-*a* to 221-*d*.

The memory units 100-*a* to 100-*d* are included with the ink packs 310 and are supplied to the user, and are mounted by the user to the sliders 240-*a* to 240-*d* in a removable state. The sliders 240-*a* to 240-*d* to which the memory units 100-*a* to 100-*d* are attached are in turn attached to the slots 230-*a* to 230-*d*, and the memory units 100 are attached to the slots 230 as a result. The memory units 100 are attached to their corresponding slots 230 and thus cannot be seen in FIG. 3. The memory units 100-*a* to 100-*d* have storage devices 110-*a* to 110-*d*, respectively (see FIG. 11).

Upon the memory unit 100 being attached to the slot 230, or in other words, upon the memory unit 100 being attached to the printing apparatus 200, the processing unit 210 of the printing apparatus 200 can access the storage device 110.

The storage device 110 includes a storage region. Communication ID information used by the processing unit 210 to specify a communication partner, ink color information corresponding to the color of the ink in the included ink pack 310, and the permitted usage amount information corresponding to the ink fill amount of the included ink pack 310 (that is, the aforementioned initial fill amount and consumed ink amount) are written into the storage region of the storage device 110 when the device is shipped from the factory.

The storage device 110 may also store validity/invalidity information (discussed later) indicating whether the memory unit 100 is valid and can be used by the printing apparatus 200 or is invalid, information indicating the printing apparatuses 200 with which the memory unit 100 is compatible, and so on. With respect to the validity/invalidity information, validity information indicating that the memory unit 100 is valid is written when the memory unit 100 is shipped from the factory. The storage device 110 can be constituted of a non-volatile memory such as an EEPROM (Electrically Erasable PROM).

The processing unit 210 includes a CPU 211, the storage unit 212, and a communication processing unit 213 (see FIG. 11), and executes printing processes of the printing apparatus 200, communication processes with the memory units 100, and so on. Specifically, the processing unit 210 controls the reading out or writing of data from or to the memory units 100-*a* to 100-*d* attached to the slots 230-*a* to 230-*d*. The processing unit 210 also carries out a process for detecting whether or not the memory units 100-*a* to 100-*d* are attached to the slots 230-*a* to 230-*d*.

The processing unit 210 carries out the counting process (a soft counting process) for finding the total estimated consumed ink amount for each ink color relative to the ink volume of a single ink pack 310 during printing. In other words, at the time of the charging process, the processing unit 210 calculates the total consumed ink amount information WD, which is a percentage of the total consumed ink amount relative to the initial fill amount stored in the storage unit 212 from the memory unit 100, for each ink color (providing WDa to WDd, which correspond to the respective colors), and updates the total consumed ink amount information WD in its own storage unit 212 each time a predetermined amount of ink is consumed by printing being executed.

In addition to the amount of ink consumed by printing, the estimated consumed ink amount counted by the processing unit 210 also includes an amount of ink consumed by print head maintenance such as cleaning the print head. The processing unit 210 updates the total consumed ink amount information WD as appropriate when maintenance is executed.

The storage unit 212 stores the initial fill amount corresponding to each ink color, the total consumed ink amount information WD corresponding to each ink color, and the prescribed threshold WTH for the total consumed ink amount information WD at which automatic charging is to be carried out, as well as a second threshold WTH' for the total consumed ink amount information WD at which printing can be continued with only a charge in the case where there is no reservation (where $WTH'=WTH+\alpha$ and $\alpha>0$; the second threshold WTH' is set to a higher value than the permitted usage amount), a charged flag, and a reserved flag, which will be described later. The storage unit 212 is constituted of a non-volatile memory.

Figure 5:
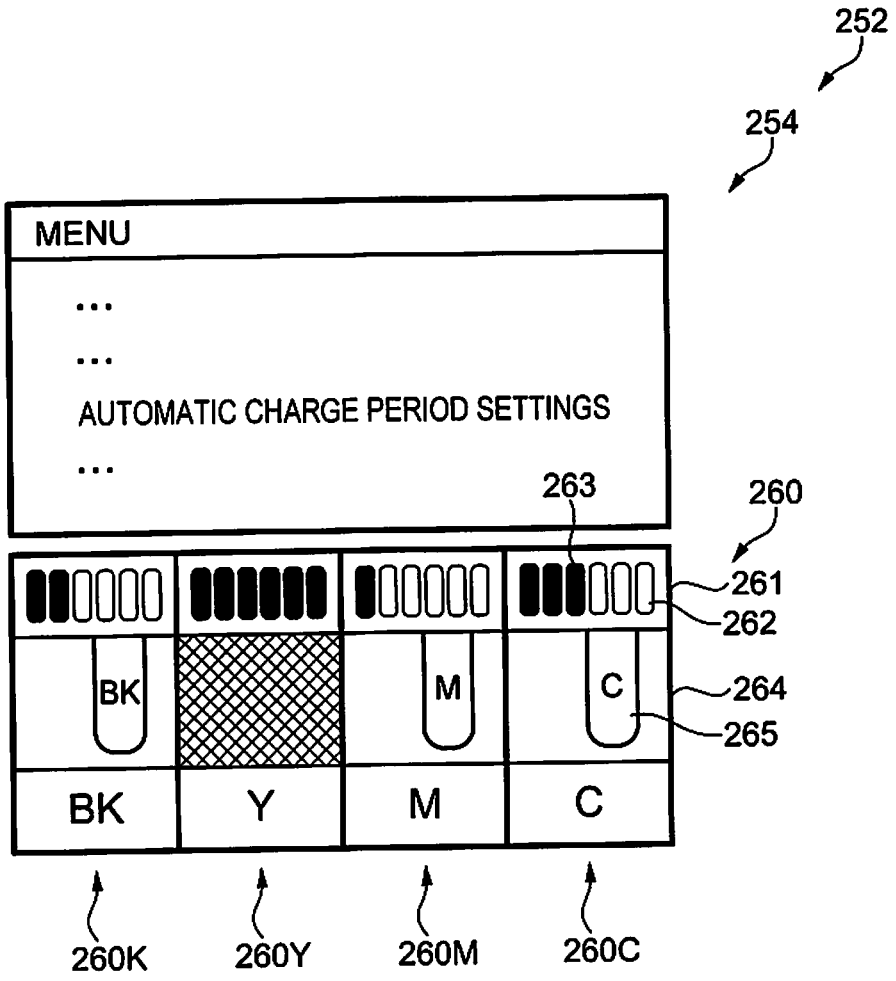
FIG. 5 is a diagram illustrating an example of the configuration of a UI unit according to the embodiment.

FIG. 5 is a diagram illustrating an example of the configuration of the UI unit 252 according to this embodiment. As illustrated in FIG. 5, the UI unit 252 includes a first display unit (also called a "menu display unit") 254 and a second display unit (also called a "remaining amount display unit") 260. The first display unit 254 is constituted of, for example, a display such as a liquid crystal display or an organic EL display, and a touch panel. Information regarding ink refilling, various types of notifications, an operation menu through which the user can perform operations, and so on are displayed in the first display unit 254. Details of the content displayed in the first display unit 254 will be given later. Note that the first display unit 254 and the second display unit 260 may be display units or the like of another device connected to the printing apparatus 200 (a PC, for example).

The second display unit 260 is constituted of, for example, a display such as a liquid crystal display or an organic EL display. The second display unit 260 is divided on the basis of the colors of ink contained in the ink tanks 221, into a second display unit 260K corresponding to black (BK), a second display unit 260Y corresponding to yellow (Y), a second display unit 260M corresponding to magenta (M), and a second display unit 260C corresponding to cyan (C). Each of the second display units 260K, 260Y, 260M, and 260C has an estimated remaining ink amount display part 261 and a reserved state display part 264. Although FIG. 5 illustrates the second display unit 260 for a case where there is a single ink tank 221 for each color of ink, it should be noted that in the case where there are a plurality of ink tanks 221 for each color of ink, the second display unit 260 is divided into units for each ink tank 221.

In the example illustrated in FIG. 5, the state of the consumed ink amount estimated on the basis of the estimated ink amount information charged by the memory unit 100 (the initial fill amount) and the consumed ink amount estimated through the counting process (the estimated consumed ink amount) (that is, the amount of ink remaining in the ink tank 221) is indicated in the estimated remaining ink amount display part 261 by six blocks. In FIG. 5, of the six blocks, white blocks 262 represent blocks that are not lit, and black blocks 263 represent blocks that are lit.

The black blocks 263 are displayed so as to correspond to the remaining ink amount estimated through the counting process (an estimated remaining ink amount), and will be referred to as "charge blocks 263" hereinafter. A greater number of charge blocks 263 displayed in the estimated remaining ink amount display part 261 indicates a greater estimated remaining ink amount (that is, a lower estimated consumed ink amount). The number of the white blocks 262 increases and the number of the charge blocks 263 decreases as ink is consumed by printing and the estimated remaining ink amount decreases (the estimated consumed ink amount increases).

In this embodiment, two or more charge blocks 263 are displayed in the case where the estimated consumed ink amount is less than 100% of the estimated ink amount information charged using the memory unit 100 (the initial fill amount), and one charge block 263 is displayed when the estimated consumed ink amount reaches 100%. As such, a case where only a single charge block 263 is displayed in the estimated remaining ink amount display part 261 corresponds, with respect to the counting process, to a state where a single ink pack 310's worth of ink (1 L) has been consumed by a printing apparatus 200 having the worst ink consumption efficiency.

For example, six charge blocks 263 are displayed in the estimated remaining ink amount display part 261 of the second display unit 260Y corresponding to yellow (Y) ink, and a sufficient amount of yellow (Y) ink is estimated to remain. However, only a single charge block 263 is displayed in the estimated remaining ink amount display part 261 of the second display unit 260M corresponding to magenta (M) ink. In this case, it is estimated that a single ink pack 310's worth of ink has been consumed, and thus the remaining ink amount may be visually confirmed and the ink refilled from an ink pack 310 once the ink surface has dropped below the lower limit line (7 cm from the bottom surface of the ink tank 221).

In the case where the charge blocks 263 are no longer displayed in the estimated remaining ink amount display part 261, the estimated consumed ink amount has reached or exceeded 120% of the initial fill amount, and the remaining ink is estimated to be low. In this case, it is desirable that the remaining ink amount be visually confirmed and the ink be refilled from an ink pack 310 once the ink surface has dropped below the lower limit line (7 cm from the bottom surface of the ink tank 221). In the case where printing is continued in such a state, there is a risk that the ink in the ink tank 221 will run out and the printing operations will stop.

Note that when no more charge blocks 263 are displayed in the estimated remaining ink amount display part 261, the automatic charging process is executed in the case where a reserved memory unit 100 is attached. When a charging process (including the automatic charging process) is executed in a state where no more charge blocks 263 are displayed, six charge blocks 263 will be displayed in the estimated remaining ink amount display part 261, as indicated by the second display unit 260Y corresponding to yellow (Y) ink.

A charged state, a reserved state, or the like based on the memory unit 100 is displayed in the reserved state display part 264. For example, nothing is displayed in the reserved state display part 264 of the second display unit 260Y corresponding to yellow (Y) ink. This indicates that the yellow (Y) ink has been charged by the memory unit 100 (the first memory unit 100-1 indicated in FIG. 2) and the first memory unit 100-1 remains attached, or has been removed but a reservation process based on a new memory unit 100 (the second memory unit 100-2) has not yet been carried out. The first memory unit 100-1 removed in this state has undergone the charging process and is thus invalidated. Additionally, in this state, the reservation process can be carried out for the second memory unit 100-2.

On the other hand, a bar indicating "C" is displayed in the reserved state display part 264 of the second display unit 260C corresponding to cyan (C) ink. This indicates that a new memory unit 100 (the second memory unit 100-2 indicated in FIG. 2) has been attached and the reservation process completed for the cyan (C) ink. When the second memory unit 100-2 is removed in this state, the reservation process is canceled and nothing is displayed in the reserved state display part 264. The second memory unit 100-2 removed in this state has not yet undergone the charging process and can therefore be used.

Bars indicating "M" and "BK" are also displayed in the reserved state display parts 264 of the second display unit 260M corresponding to magenta (M) ink and the second display unit 260K corresponding to black (BK) ink, which indicates that the second memory unit 100-2 has been attached and the reservation process completed for the magenta (M) ink and a black (BK) ink as well.

Note that the automatic charging process is carried out when, in the reserved state in which the "C" bar is displayed in the reserved state display part 264 of the second display unit 260C, the initial fill amount of ink charged using the first memory unit 100-1 is consumed and the estimated ink amount information reaches the prescribed threshold WTH. When the automatic charging process is carried out, the first memory unit 100-1 is invalidated and nothing is displayed in the reserved state display part 264, in the same manner as with the second display unit 260Y.

FIG. 6 is a side view illustrating an example of the configuration of the ink tank 221 and the slider 240 according to the embodiment. As illustrated in FIG. 6, the ink tank 221 includes an ink supply opening 222. The user can fill the ink tank 221 with the ink contained in the ink pack 310 from the ink supply opening 222. The ink tank 221 is fixed to the slot 230 (see FIG. 3) of the printing apparatus 200, and can be filled with ink while in this fixed state. The ink tank 221 can be filled with ink while the slider 240 is attached to the slot 230 by opening an ink supply opening cover 242 provided in the slider 240.

The slider 240 can be attached to and removed from the printing apparatus 200 by sliding an upper portion of the ink tank 221. When attaching the memory unit 100 to the slot 230, the user pulls the slider 240 out from the slot 230, attaches the memory unit 100 to an attachment direction-side tip portion of the slider 240, and reinserts the slider 240 into the slot 230 in the attachment direction. FIG. 6 illustrates a state in which the memory unit 100 is attached to the slider 240.

Figure 7:
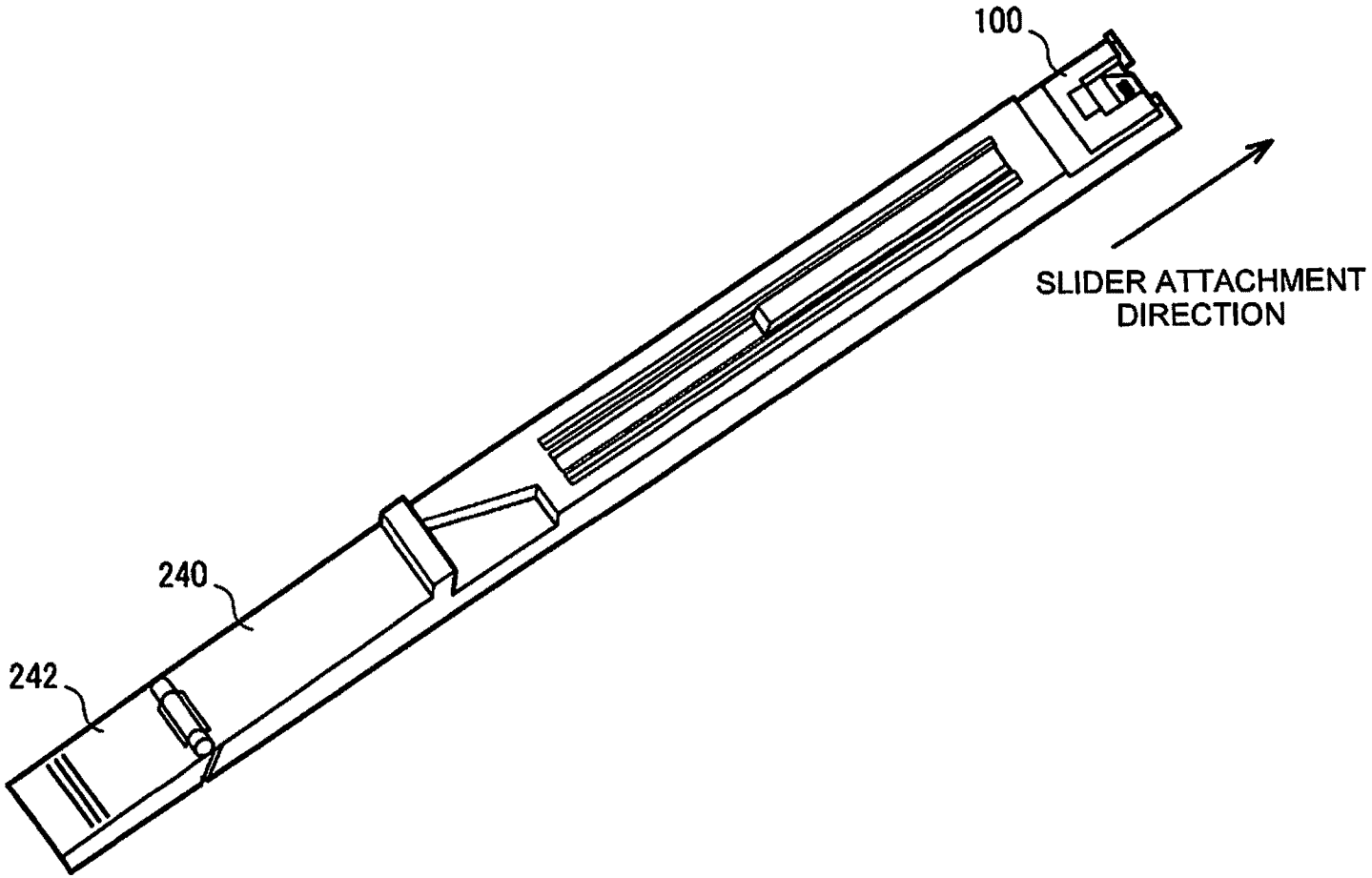
FIG. 7 is a perspective view illustrating an example of the configuration of the slider according to the embodiment.

FIG. 7 is a perspective view illustrating an example of the configuration of the slider 240 according to this embodiment. As illustrated in FIG. 7, the memory unit 100 is attached to the attachment direction-side tip portion of the slider 240. Here, "attached" means that the memory unit 100 is placed on a predetermined location of the slider 240. It is not necessary that the memory unit 100 be fixed to a predetermined location of the slider 240.

Figure 8:
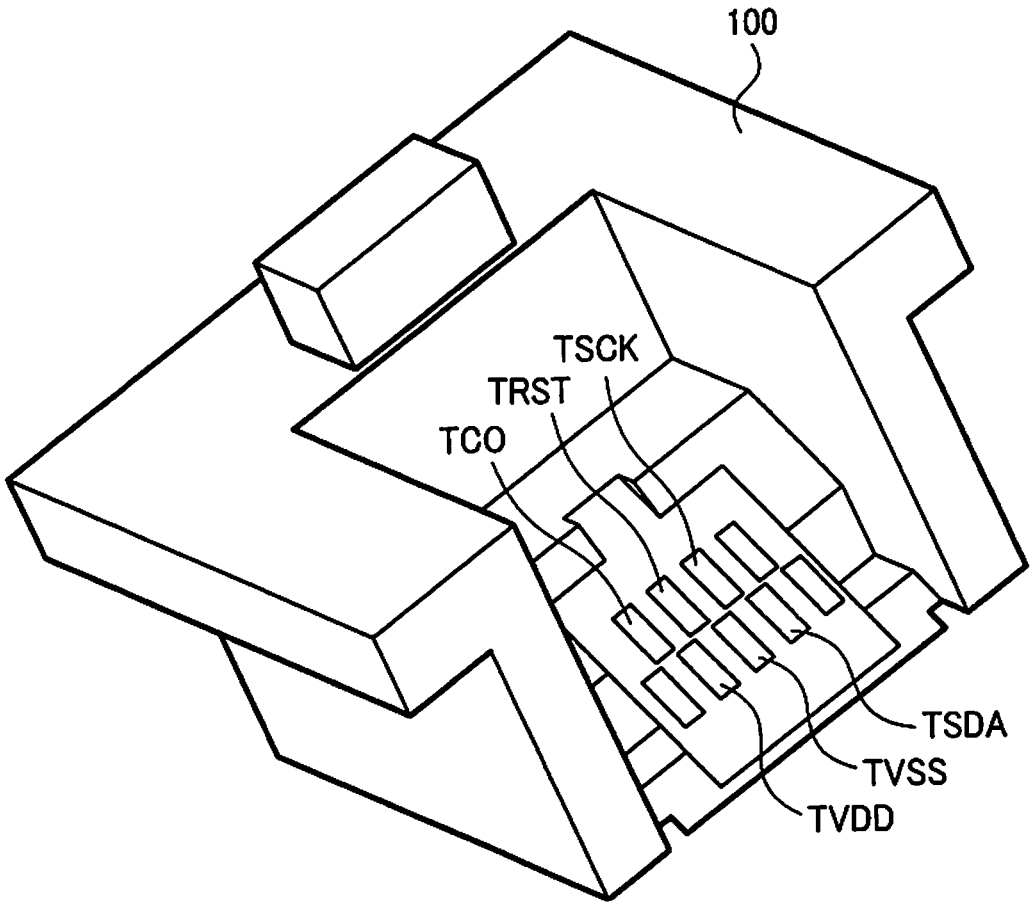
FIG. 8 is a perspective view illustrating an example of the configuration of a memory unit according to the embodiment.

FIG. 8 is a perspective view illustrating an example of the configuration of the memory unit 100 according to this embodiment. As illustrated in FIG. 8, the memory unit 100 includes the storage device 110 (see FIG. 11), a reset terminal TRST, a clock terminal TSCK, a data terminal TSDA, a first power source terminal TVDD, a second power source terminal TVSS, and an attachment detection terminal TCO. Attaching the memory unit 100 to the slot 230 electrically connects these terminals to main unit-side terminals CRST, CSCK, CSDA, CVDD, CVSS, and CCO, respectively, of the printing apparatus 200, which are provided in the slot 230. Note that the reset terminal TRST, clock terminal TSCK, data terminal TSDA, first power source terminal TVDD, and second power source terminal TVSS are also collectively called "storage device terminals". Additionally, the number and arrangement of the terminals is not limited to those illustrated in FIG. 8, and a variety of numbers and arrangements are possible.

Figure 9:
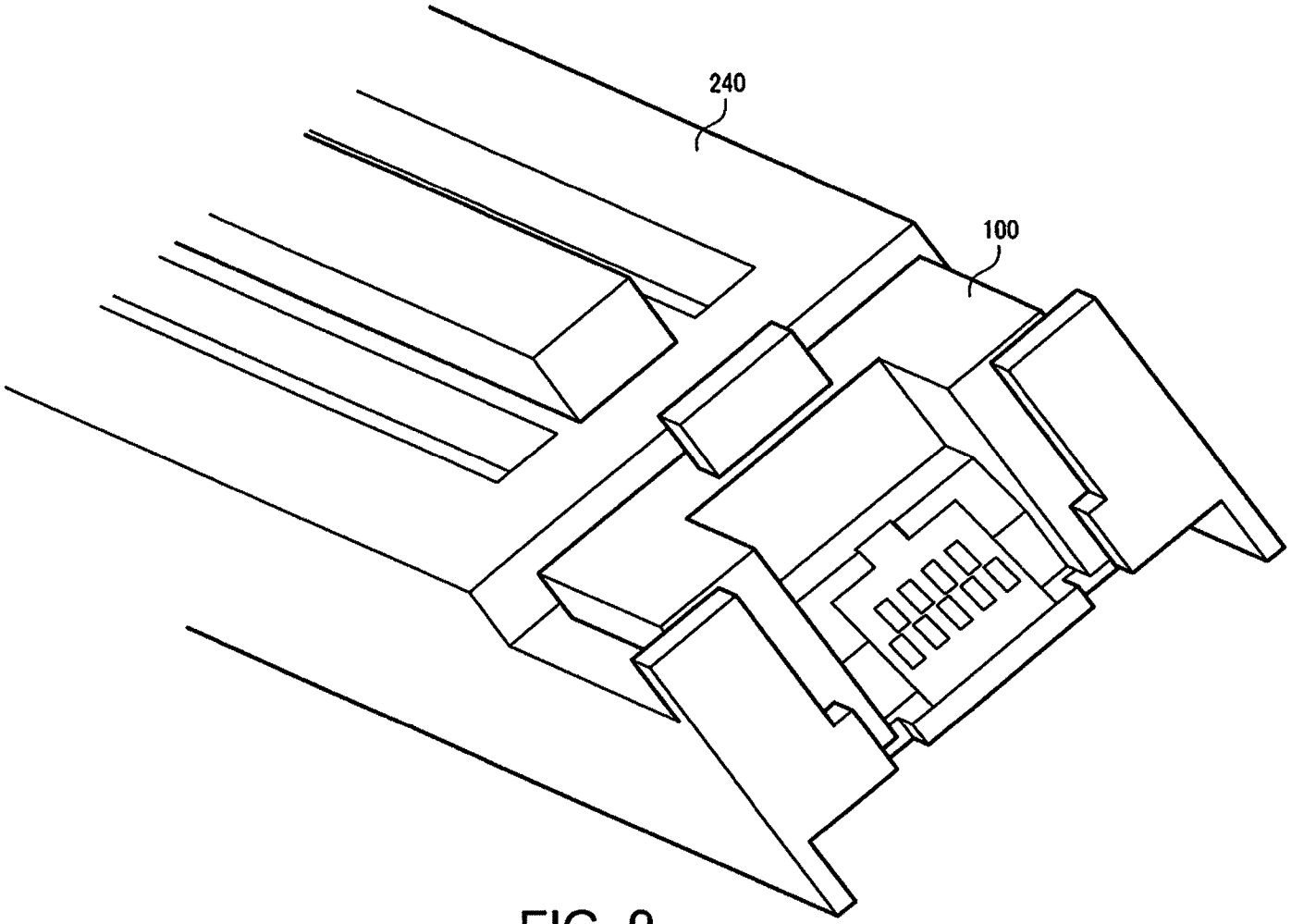
FIG. 9 is a perspective view illustrating an example of the configuration of a tip portion of the slider in which the memory unit according to the embodiment is installed.

FIG. 9 is a perspective view illustrating an example of the configuration of the tip portion of the slider 240 to which the memory unit 100 is attached, according to this embodiment. As illustrated in FIG. 9, the memory unit 100 is attached to the attachment direction-side tip portion of the slider 240.

Figure 10:
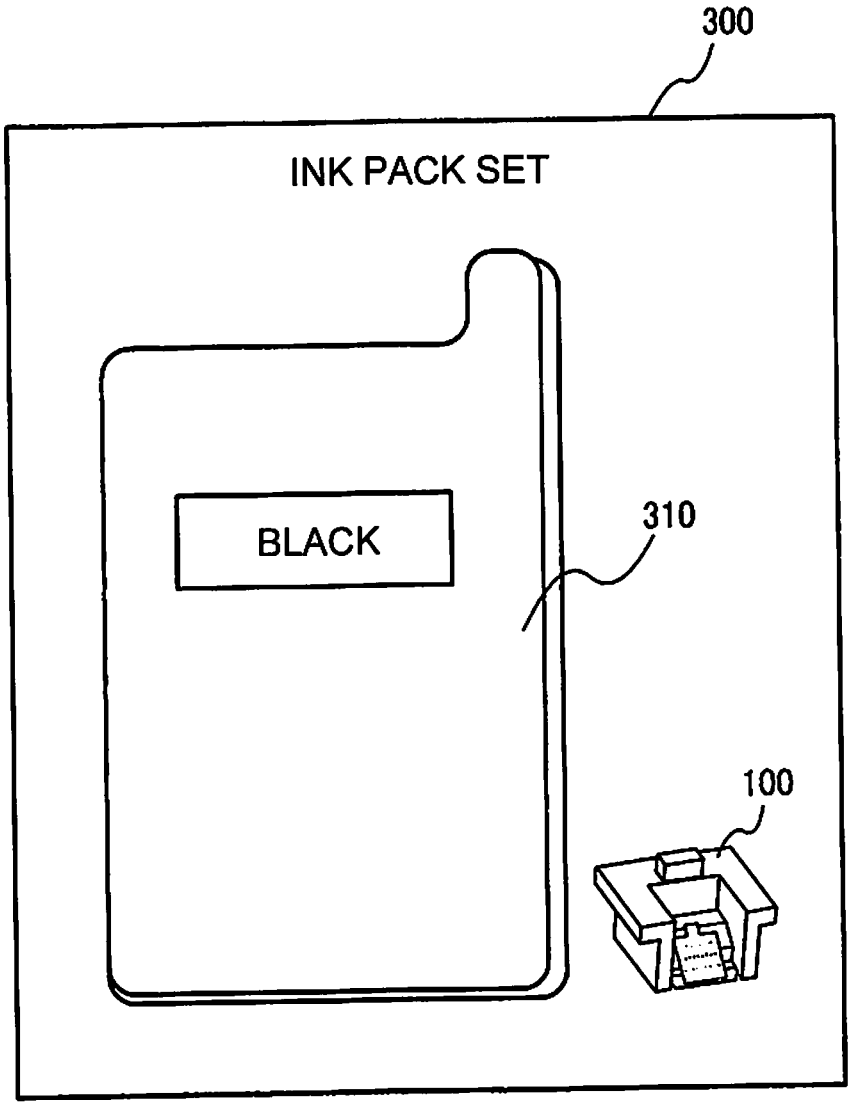
FIG. 10 is a schematic diagram illustrating an example of the configuration of an ink pack set according to the embodiment.

FIG. 10 is a schematic diagram illustrating an example of the configuration of the ink pack set 300 according to the embodiment. As illustrated in FIG. 10, the ink pack set 300 includes the ink packs 310 (also called ink refill receptacles) and the memory units 100, and these are packaged together. For example, a black ink pack set 300 includes ink packs 310 containing black ink and a memory unit 100 in which black ink color information is stored, and these items are packaged together. The ink packs 310 are bags (pouches), formed from a laminated film, for example, that have been filled with ink. The ink pack set 300 is supplied to the user of the printing apparatus 200 by the printing apparatus vendor.

Figure 11:
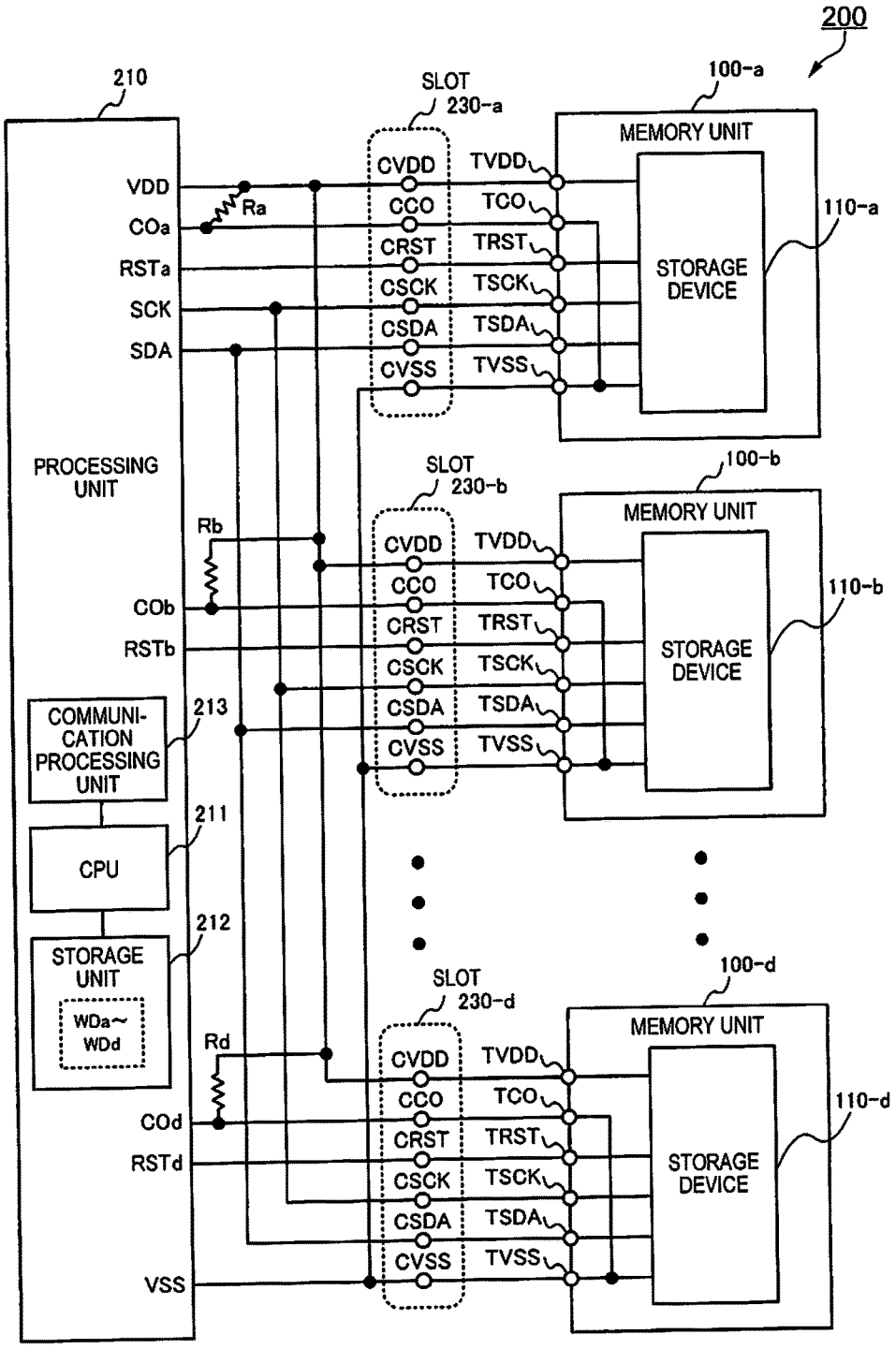
FIG. 11 is a block diagram illustrating an example of the configuration of slots, memory units, and a processing unit of the printing apparatus according to the embodiment.

FIG. 11 is a block diagram illustrating an example of the configurations of the slots 230-*a* to 230-*d* of the printing apparatus 200, the memory units 100-*a* to 100-*d*, and the processing unit 210, according to this embodiment.

As illustrated in FIG. 11, the memory units 100-*a* to 100-*d* each include the reset terminal TRST, the clock terminal TSCK, the data terminal TSDA, the first power source terminal TVDD, and the second power source terminal TVSS as the storage device terminals. The storage device terminals are electrically connected to the storage device 110 in each memory unit 100.

Each of the memory units 100-*a* to 100-*d* also includes the attachment detection terminal TCO. In each memory unit 100, the attachment detection terminal TCO is electrically connected to the second power source terminal TVSS.

By attaching the memory unit 100-*a* to the slot 230-*a*, the storage device terminals TRST, TSCK, TSDA, TVDD, TVSS, and the attachment detection terminal TCO, are electrically connected to the main unit-side terminals CRST, CSCK, CSDA, CVDD, CVSS, and CCO, respectively, provided in the slot 230-*a*. The same applies to the memory units 100-*b* to 100-*d*.

Of the main unit-side terminals provided in the slots 230-*a* to 230-*d*, the clock terminal CSCK, the data terminal CSDA, the first power source terminal CVDD, and the second power source terminal CVSS are connected in common to a clock terminal SCK, a data terminal SDA, a first power source terminal Vdd, and a second power source terminal Vss, respectively, of the processing unit 210. The processing unit 210 outputs a clock signal SCK to the clock terminal CSCK, a first power source voltage (a high potential-side power source voltage) VDD to the first power source terminal CVDD, and a second power source voltage (a low potential-side power source voltage) VSS to the second power source terminal CVSS. Additionally, the processing unit 210 outputs a data signal SDA to the data terminal CSDA, and receives the data signal SDA from the data terminal CSDA.

The processing unit 210 outputs reset cancel signals RSTa to RSTd to the reset terminals CRST provided in the slots 230-*a* to 230-*d*. A storage device to which the processing unit 210 is outputting a reset cancel signal is a storage device that is to be accessed by the processing unit 210.

The processing unit 210 includes the CPU 211, the storage unit 212, and the communication processing unit 213. The processing unit 210 executes processes for communicating with the memory units 100 via the communication processing unit 213.

The processing unit 210 can detect whether a memory unit 100 is attached to a slot 230 using the attachment detection terminal TCO. For example, in the case of an attachment detection made for the slot 230-*a*, the processing unit 210 outputs the first power source voltage VDD to the first power source terminal CVDD and detects whether or not the memory unit 100-*a* is attached on the basis of a voltage level of an attachment detection signal COa. The main unit-side attachment detection terminal CCO of the slot 230-*a* is connected to the first power source terminal CVDD via a resistance element Ra, and thus the voltage level of the attachment detection signal COa is H level (high-potential level; VDD level) in the case where the memory unit 100-*a* is not attached.

On the other hand, in the case where the memory unit 100-*a* is attached, the main unit-side attachment detection terminal CCO, the attachment detection terminal TCO of the memory unit 100-*a*, and the second power source terminal TVSS are electrically connected, and thus the voltage level of the attachment detection signal COa is L level (low-potential level; VSS level). Accordingly, the processing unit 210 determines that the memory unit is not attached in the case where the attachment detection signal COa is H level, and determines that the memory unit is attached in the case where the attachment detection signal COa is L level. In this manner, the processing unit 210 can detect whether or not a memory unit 100 is attached to each of the slots 230-*a* to 230-*d*.

In the configuration example illustrated in FIG. 11, the processing unit 210 can select a single memory unit 100 and read out or write therefrom or thereto by activating one of the reset cancel signals RSTa to RSTd (that is, canceling the reset).

3. Charging Process and Reservation Process

The charging process and the reservation process will be described in detail next. Note that FIG. 3 illustrates an example of a printing apparatus 200 having ink tanks 221 for four colors and a plurality of slots 230 corresponding to those respective colors, where the memory units 100 can be attached to and removed from corresponding slots. However, the first memory unit 100-1 and the second memory unit 100-2 in the charging process and reservation process illustrated in FIG. 2 indicate memory units 100 corresponding to a single prescribed color, and the aforementioned slot 230 also indicates a single slot for a prescribed color. For example, the technique according to this embodiment defines a process carried out in the case where a black memory unit 100 has been attached to a black slot 230, and another black memory unit 100 has then been attached to the black slot 230 after the initial memory unit 100 has been removed.

The charging process and reservation process according to this embodiment will be described using FIGS. 12 to 14. As described earlier, the storage unit 212 stores the charged flag and the reserved flag.

The charged flag is a flag indicating whether or not the main unit-side estimated ink amount information has been updated (charged) using the permitted usage amount information from a prescribed memory unit 100. The charged flag is set to an on state by the charging process, and a value of 1 is stored in an area of the storage unit 212 for the charged flag. The reservation process is carried out under the condition that charging is complete, and thus the charged flag may be thought of as a reservation standby flag.

The reserved flag is a flag indicating whether or not the second memory unit 100-2 has been attached and a charging process using the second memory unit 100-2 reserved after a charging process carried out by the first memory unit 100-1. The reserved flag is set to an on state by carrying out the reservation process, and a value of 1 is stored in the storage unit 212. Hereinafter, 1 or 0 being stored as a flag state will also be referred to as setting a flag of 1 or 0.

Figure 12:
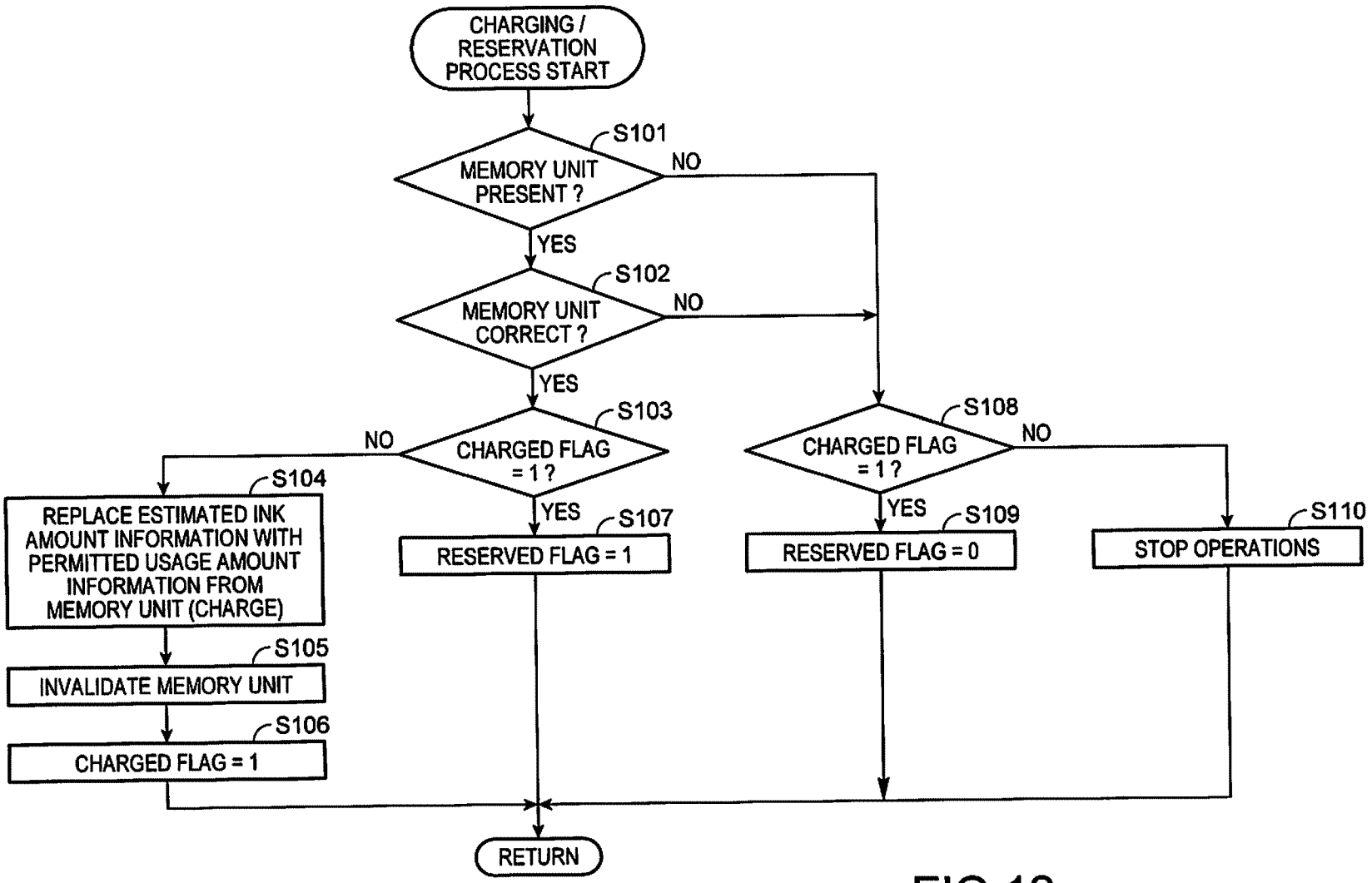
FIG. 12 is a flowchart illustrating a charging process and a reservation process using flags based on a memory unit attachment state.

FIG. 12 is a flowchart illustrating the charging process and the reservation process using flags based on the attachment state of the memory unit 100. These processes are processes executed by the processing unit 210. Note that each step can be rearranged in any desired order or executed in parallel as long as doing so does not cause conflict in the processing content.

Upon the processing being started, first, it is determined whether or not the memory unit 100 is attached to the slot 230 (step S101). As described earlier, this is determined by the state of the signal COa. In the case where the memory unit 100 is attached (step S101: YES), the process moves to step S102, where it is determined whether or not the memory unit 100 is correct (step S102).

In step S102, it is determined whether the memory unit 100 is valid or invalid. A memory unit 100 whose permitted usage amount information is already been replaced (that is, has been charged) cannot be reused, and is thus set to invalid by the processing unit 210. In the case where the attached memory unit 100 is invalid, the memory unit 100 is determined to be incorrect in step S102 (step S102: NO), and the process moves to step S108.

In step S102, a correspondence relationship between the attached memory unit 100 and the slot 230 may be determined. For example, in the case where a memory unit 100 corresponding to a color that is not black (that is, cyan, magenta, or yellow) is attached to the black slot 230, the memory unit 100 is determined to be incorrect.

Meanwhile, in the case where printing apparatuses 200 with which the memory unit 100 is compatible is stored, a correspondence relationship with the printing apparatus 200 is determined. In the case where the printing apparatus 200 does not match the printing apparatuses 200 stored in the memory unit 100, or a printing apparatus 200 with which the memory unit 100 is compatible is not stored, the memory unit 100 is determined to be incorrect.

In other words, the process for determining whether or not a unit is "correct" is in this embodiment a process of determining one or more conditions including at least a determination as to whether the unit is "valid" or "invalid". In the case where the determination is carried out based on a plurality of conditions, the unit is ultimately determined to be correct when basically all of the conditions are determined to be correct.

In the case where the memory unit 100 is determined to be correct (step S102: YES), the process moves to step S103, where a determination of the charged flag is carried out (step S103). In the case where the charged flag is 0 (step S103: NO), the charging process is carried out using the attached correct memory unit 100 (the first memory unit 100-1).

Specifically, the estimated ink amount information is updated using the permitted usage amount information from the memory unit 100 (step S104). Additionally, because the permitted usage amount information from the memory unit 100 is moved to the printing apparatus 200 main unit side as a result, the memory unit 100 is stored as invalid in order to prevent the memory unit 100 from being reused (step S105). Then, because the charging process is complete, the charged flag is set to 1 (step S106).

Meanwhile, a case where the charged flag is 1 in step S103 (step S103: YES) corresponds to a state in which a valid memory unit 100 has been attached in a state where the charging process has already been carried out. Accordingly, it is assumed that the charging process has been reserved by the attached memory unit 100 (corresponding to the aforementioned second memory unit 100-2), and the reserved flag is set to 1 (step S107).

On the other hand, in the case where no memory unit 100 is attached or the attached memory unit 100 is incorrect (step S101: NO or step S102: NO), a determination of the charged flag is carried out (step S108).

In the case where the charged flag is 1 (step S108: YES), the charging process has been carried out, and thus printing operations can be continued. This is because as described above, in this embodiment, the printing operations are not affected even if the charged memory unit 100 is removed. Meanwhile, although the charging is complete, a memory unit 100 is not attached or is attached but is an incorrect memory unit 100, and thus a reservation process using the second memory unit 100-2 cannot be executed. Accordingly, the reservation process is incomplete, and the reserved flag is set to 0 (step S109).

Note that while there are cases where step S109 is carried out while the reserved flag is 1, there are also cases were step S109 is carried out while the reserved flag is 0. The reserved flag being 1 corresponds to a state in which a correct memory unit 100 has been attached and the process of step S107 has been carried out after the charging process, but that memory unit 100 has then been removed (and furthermore, depending on the situation, a different, incorrect memory unit 100 has then been attached). In this case, the memory unit 100 used for reservation purposes has been removed, resulting in a reserved state; thus the process of step S109 is a process for returning the reserved flag, which was 1, to 0.

Meanwhile, a case where the process of step S109 is carried out while the reserved flag is 0 corresponds to a situation in which the reservation process has not been carried out and a valid memory unit 100 has not been attached thereafter, and thus in step S109, a reserved flag that is 0 remains 0.

Considering the display of information to the user, step S109 may be thought of as being divided into two processes, namely (1) a case where the reserved flag is changed from 1 to 0 and (2) a case where the reserved flag is kept at 0. For example, in the case where the process of step S109 is carried out when the reserved flag is 1 (the case (1)), the user is notified that the reservation already made has been canceled. Meanwhile, in the case where the process of step S109 is carried out when the reserved flag is 0 (the case (2)), information for prompting the user to make a correct reservation, such as text reading "to make a reservation, please attach a correct memory unit", is displayed. The operations made by the user may be facilitated by displaying the information along with information specifying a color.

Meanwhile, in the case where the charged flag is 0 in the determination of step S108 (step S108: NO), the printing operations are stopped (step S110). As will be described later using FIGS. 13 and 14, the charged flag according to this embodiment is a flag set to 1 as a result of the charging process, and the flag is set to 0 in the case where the estimated consumed ink amount (the total consumed ink amount information WD) has reached the second threshold WTH' (=WTH+α), which is greater than the prescribed threshold WTH.

This second threshold WTH' is a greater value than the ink amount corresponding to the permitted usage amount. The second threshold WTH' is set using, as a guideline, the estimated value of the total consumed ink amount information WD at which a printing apparatus 200 having the best ink consumption efficiency uses up an amount of ink equivalent to the initial fill amount of a single ink pack (135%, for example). Doing so makes it possible to continue printing in the case where ink remains even after the prescribed threshold WTH is exceeded in the printing apparatus 200 having the best ink consumption efficiency. Furthermore, a case where ink remains despite 135% being reached is conceivable in the case where the prescribed threshold WTH is exceeded in a state where there is no reservation, after automatic charging operations are carried out at the prescribed threshold WTH following a reservation being made. For this reason, the second threshold WTH' may be set to approximately 170%.

Figure 13:
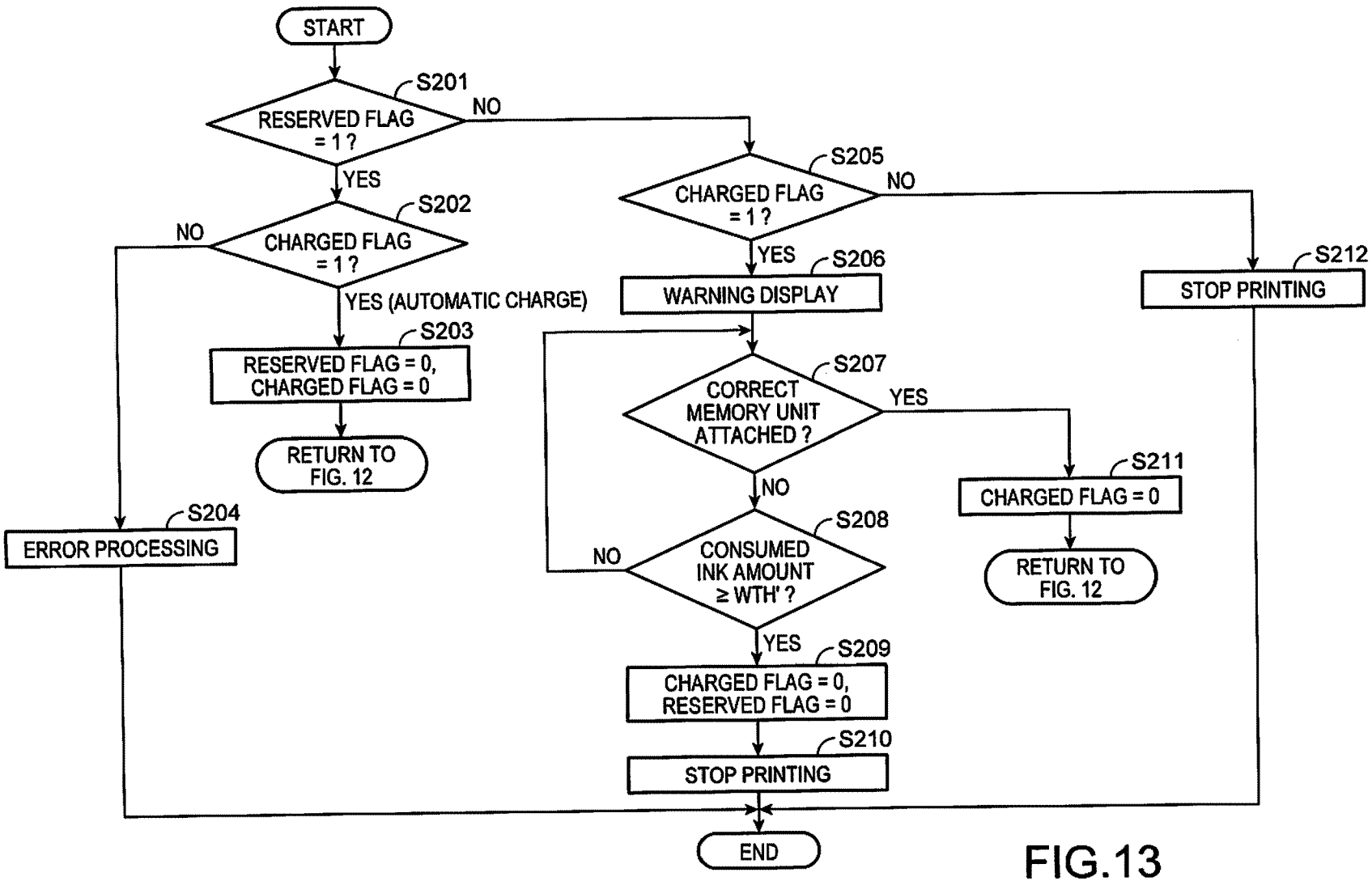
FIG. 13 is another flowchart illustrating processing carried out in the case where total consumed ink amount information has exceeded a prescribed threshold.

FIG. 13 is flowchart illustrating processing carried out in the case where the total consumed ink amount information WD has exceeded the prescribed threshold WTH. These processes are processes executed by the processing unit 210. Upon the processing being started, first, determinations of the charged flag and the reserved flag are carried out (step S201, step S202, and step S205).

A case where the reserved flag is set to 1 and the charged flag is set to 1 (step S201: YES and step S202: YES) indicates that a valid second memory unit 100-2 is attached and the total consumed ink amount information WD has exceeded the prescribed threshold WTH in a reserved state. Accordingly, the processing unit 210 carries out automatic charging using the attached memory unit 100.

In the automatic charging process, first, the reserved flag and the charged flag are both set to 0 (step S203), after which the process returns to step S104 in FIG. 12. The reserved flag is set to 0 in step S203 because the memory unit 100 for the reservation is now subject to the charging process, and the reserved state will be cancelled (in other words, the second memory unit 100-2 will become the first memory unit 100-1). Meanwhile, the charged flag is set to 0 because the amount of ink charged by the memory unit 100 attached before the memory unit 100 attached now has been used up.

Returning the process to FIG. 12 is preparation for the charging process using the reserved memory unit 100 (step S104). Additionally, the processes of step S105 and step S106 will be carried out in the case where the process returns to FIG. 12, and thus the second memory unit 100-2 (which at this point in time corresponds to the first memory unit 100-1 rather than the second memory unit 100-2) will be set to invalid and the charged flag will once again be set to 1.

Meanwhile, in the case where the reserved flag is set to 0 and the charged flag is set to 1 (step S201: NO and step S205: YES), the total consumed ink amount information WD has exceeded the prescribed threshold WTH but no reservation is made, and thus the automatic charging is not carried out. If more ink is consumed after the prescribed threshold WTH corresponding to the permitted usage amount information, and the total consumed ink amount information WD exceeds the second threshold WTH', the printing cannot be continued any longer, and thus a warning display is made to that effect (step S206).

Under these circumstances, a determination as to whether a correct memory unit 100 has been attached (step S207) and a determination as to whether the total consumed ink amount information WD is greater than or equal to the second threshold WTH' (step S208) are carried out. Note that step S207 is the same process as step S102. A determination of YES in step S208 corresponds to a state in which, without a correct memory unit 100 being attached, the estimated consumed ink amount is too high for printing operations to continue.

Accordingly, in the case where a correct memory unit 100 has not been attached before the total consumed ink amount information WD has reached or exceeded the second threshold WTH' (step S207: NO and step S208: YES), the charged flag and the reserved flag are both set to 0 (step S209) and the printing operations are stopped (step S210). This is a process corresponding to a case where no memory unit is determined to be present in step S101 of FIG. 12, the charged flag is determined to be 0 in step S108 (with the charged flag determined to be 0 in step S108 as a result of the step S209), and the process moving to step S110.

On the other hand, in the case where a correct memory unit 100 has been attached before the total consumed ink amount information WD has reached or exceeded the second threshold WTH' (step S207: YES), the charged flag is set to 0 (step S211) and the process returns to FIG. 12. Step S211 is preparation for carrying out charging operations using a newly-attached memory unit 100 after the charged amount has already been consumed.

Note that a case where the reserved flag is set to 1 and the charged flag is set to 0 (step S201: YES and step S202: NO) is a state that cannot arise under the flag management according to this embodiment. This is because the reservation process is a process carried out under the condition that charging is complete, and it is not possible to enter a reserved state, with the reserved flag being set to 1, while remaining uncharged. Thus in this case, error processing is carried out (step S204). Various processes are conceivable for the specific details of the error processing, but for example, both the charged flag and the reserved flag are set to 0 and the printing operations stopped.

Meanwhile, in the case where the reserved flag is set to 0 and the charged flag is set to 0 (step S201: NO and step S205: NO), the printing operations are stopped (step S212). Step S212 is the same process as step S110.

Note that as described above, the charged flag is 0 in the case where the estimated consumed ink amount has exceeded the second threshold WTH' (step S209) or in the case where preparations for the charging process are complete (step S203 or step S211). Accordingly, if the charged flag is set to 0, either the printing operations are stopped (step S210) or the charged flag is restored to 1 immediately (step S106), but a situation in which normal printing operations are continued while the charged flag is 0 is not conceivable.

Figure 14:
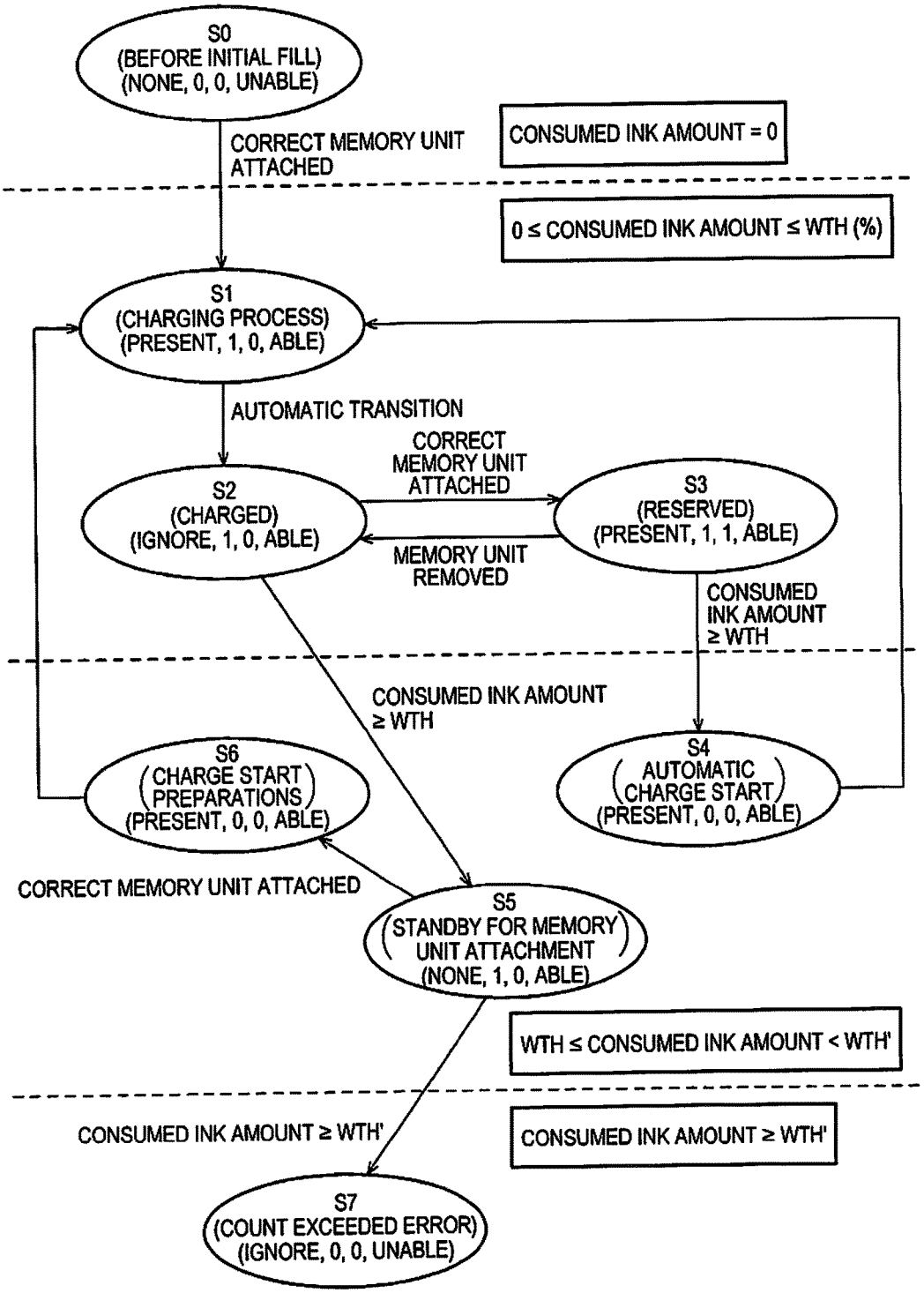
FIG. 14 is a state transition diagram corresponding to processing according to the embodiment.

FIG. 14 is a state transition diagram corresponding to processing according to the embodiment. The four parameters in each state illustrated in FIG. 14 indicate, from the left, the attachment state of the memory unit 100, the state of the charged flag, the state of the reserved flag, and whether or not printing operations can be carried out. For example, (none, 0, 0, unable) indicates that no memory unit 100 is attached, the charged flag and the reserved flag are both set to 0, and printing operations cannot be carried out.

A state S0 corresponds to a state before an initial fill of the print head, or in other words, a state in which the user has purchased the printing apparatus 200 but has not yet used the printing apparatus 200 and the print head is therefore not yet filled with ink. In the state S0, the memory unit 100 is not attached, the charged flag and the reserved flag are both 0, and printing operations cannot be carried out. In this case, neither the charging process nor the printing operations has been started, the total consumed ink amount information WD (estimated consumed ink amount) is 0%, and the apparatus is standing by for a correct memory unit 100 to be attached.

In the case where a correct memory unit 100 has been attached in the state S0, the state moves to a state S1, where the charging process is executed. In the state S1, a memory unit 100 is attached and that memory unit 100 is correct, and thus the charged flag is set to 1 by the charging process, and printing operations can be carried out. The reserved flag remains 0. Note that in order for printing operations to become possible here, it is necessary for the user to fill the ink tank 221 with ink and the sensor to detect that there is ink.

Although a correct memory unit 100 being attached is a prerequisite for state S1, the memory unit 100 can be removed following the charging process. Accordingly, after the charging process is executed as a result of the state S1, the state automatically moves to a state S2, which corresponds to the charging being complete.

In the state S2, the attachment state of the memory unit 100 is different, namely "ignore". In other words, in the state S2, the memory unit 100 may be attached or removed. Additionally, although the attachment state of the memory unit 100 is of no consequence in the state S2, whether a correct memory unit 100 has been attached is monitored as a condition for the state moving to a state S3.

In the case where a correct memory unit 100 has been attached in the state S2, the state moves to the state S3. The state S3 corresponds to a reserved state. Accordingly, in the state S3, the reservation process is carried out using the attached correct memory unit 100, and thus the memory unit 100 is attached, the charged flag and the reserved flag are both set to 1, and printing operations can be carried out.

Meanwhile, in the case where the memory unit 100 is removed in the state S3, the memory unit 100 for the reservation is no longer present and thus the state returns to the state S2. In other words, the state S2 corresponds to a charged and unreserved state.

Furthermore, in the case where the estimated consumed ink amount (total consumed ink amount information WD) managed on the main unit side has reached or exceeded the prescribed threshold WTH in the state S3, the charging process (automatic charging) is carried out using the memory unit 100 used for the reservation. As such, first, the state moves to a state S4. In the state S4, the charged flag and the reserved flag are both set to 0. The state S4 corresponds to step S203 in FIG. 13.

The state then automatically moves from the state S4 to the state S1, and furthermore automatically moves to the state S2, and the charging process using the memory unit 100 that has been reserved is executed as a result.

On the other hand, in the case where the total consumed ink amount information WD has reached or exceeded the prescribed threshold WTH in the state S2, the state moves to a state S5. The state S5 is a state in which a correct memory unit 100 is not attached and thus the charging process cannot be executed, despite it being necessary to carry out a charging process using a new memory unit 100. However, because the total consumed ink amount information WD has not reached the second threshold WTH', printing operations can be continued in the state S5.

In the case where a correct memory unit 100 has been attached in the state S5, the state moves to a state S6. The state S6 is a stage of preparation for a charging process executed manually by the user, and thus the charged flag is changed from 1 to 0, and the state moves to the state S1. In this case as well, the state automatically moves to the state S2 and the charging process is completed.

In other words, transitions of state S3→state S4→state S1→state S2 correspond to a transition from reservation to automatic charging, whereas transitions of state S2→state S5→state S6→state S1→state S2 correspond to manual charging resulting from the user attaching a memory unit 100.

Meanwhile, in the case where, in the state S5, the total consumed ink amount information WD reaches or exceeds the second threshold WTH' (=WTH+α) without a correct memory unit 100 being attached, the state moves to a state S7, which corresponds to a count exceeded error. In the state S7, the charged flag and the reserved flag are both set to 0, and printing operations cannot be carried out, regardless of the attachment state of the memory unit 100. Although a transition from a state aside from the state S5 to the state S7 is inconceivable during normal operations, a transition from a state aside from the state S5 to the state S7 may be permitted during some sort of error. In other words, the state may move to the state S7 regardless of the current state in the case where the total consumed ink amount information WD has reached or exceeded the second threshold WTH'.

In the foregoing descriptions, the determination as to whether the memory unit 100 is valid or invalid (more broadly, the determination as to whether or not the memory unit 100 is correct) is carried out regardless of the timing of the charging process, as indicated by step S102 in FIG. 12. However, the invention is not limited to such a configuration, and for example, an embodiment in which the determination as to whether the memory unit 100 is valid or invalid is carried out upon the memory unit 100 being attached so as to avoid repeating the determination during the automatic charging is also possible. Alternatively, rather than determining whether the memory unit 100 is valid or invalid upon the memory unit 100 being attached, the determination may be carried out during the charging process.

To suppress the improper reuse of the memory unit 100, the processing unit 210 sets the memory unit 100 to invalid in the case where the charging process has been carried out using the memory unit 100. The processing for carrying out this setting corresponds to step S105 of FIG. 12.

Permitting a memory unit 100 that has been used once to be reused makes proper ink management impossible. In this embodiment, "using" the memory unit 100 can be thought of as the timing at which the main unit-side estimated ink amount information is updated (replaced) with the permitted usage amount information, or in other words, the timing at which the charging process is carried out, and thus carrying out such state management makes it possible to use the printing apparatus 200 properly.

4. Setting Process for Reducing Error

As described above, in the case where error arises between the estimated consumed ink amount estimated by the processing unit 210 through the counting process and the actual consumed ink amount, there is a risk that the automatic charging will be carried out at an inappropriate timing with respect to the timing at which the ink is filled. Accordingly, with the printing apparatus 200 according to this embodiment, in the case where error has arisen between the estimated consumed ink amount and the actual consumed ink amount, settings are made so as to reduce that error and ensure that the automatic charging is carried out at an appropriate timing.

Here, with the printing apparatus 200 according to this embodiment, even printing apparatuses 200 having the same model number will have different actual consumed ink amounts depending on the usage environment, usage conditions, and the like of the user of the printing apparatus 200, and thus the actual consumed ink amount cannot be known. It is therefore desirable for a setting process to be carried out on the basis of user inputs. The user can visually confirm the ink amount, and thus in the case where error has arisen between the estimated consumed ink amount estimated by the printing apparatus 200 and the actual consumed ink amount, the user can communicate (teach) that information to the printing apparatus 200. The processing unit 210 may present assistive information, which makes it easy for the user to teach in this manner, through the UI unit 252, and may, for example, display a screen including information for input instructions in the UI unit 252. A specific example of a setting process for reducing error will be described hereinafter.

4.1 Setting in Advance

First, a working example of a process for setting the prescribed threshold WTH will be described. In the above-described case of use in high temperatures, the user can recognize that the automatic charging is not executed despite the ink consumption progressing, or in other words, that the timing of the automatic charging is late. Meanwhile, in a case of use in low temperatures, a case where clogging has occurred, or the like, the user can recognize that the automatic charging is executed despite the ink not been consumed, or in other words, the timing of the automatic charging is early.

Specifically, the user can obtain whether or not the printing apparatus 200 is in the charged state, whether or not the printing apparatuses in the reserved state, and the current estimated ink amount information through the UI unit 252 of the printing apparatus 200 (see FIG. 5), and can also visually confirm the actual amount of ink in the ink tank 221. Accordingly, when the memory unit 100 for reservation is not charged despite a visual confirmation of the ink surface dropping to a position below the lower limit line while in a reserved state, the user can recognize that the timing of the automatic charging is late. Likewise, when the memory unit 100 for reservation is charged despite the ink surface not having dropped to a position below the lower limit line, the user can recognize that the timing of the automatic charging is early.

If the printing apparatus 200 can accept an input based on this user recognition of "early" or "late", the prescribed threshold WTH can be set appropriately.

Figure 15:
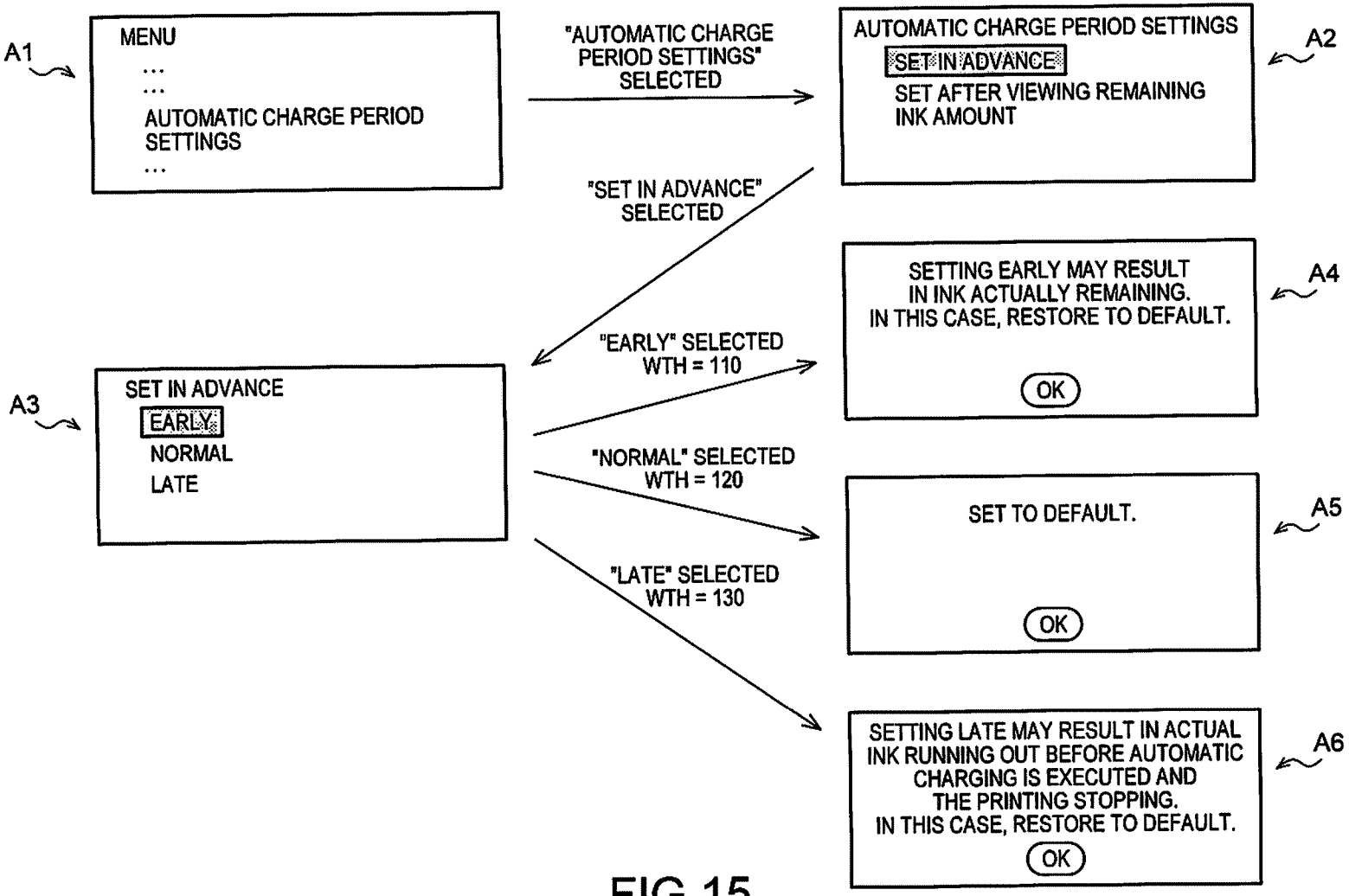
FIG. 15 is a diagram illustrating an example of transitions in a display screen used in a threshold setting process.

FIG. 15 is a diagram illustrating an example of transitions in a display screen used in a threshold setting process. The display screens illustrated in FIG. 15 are displayed by the processing unit 210 in the first display unit 254 of the UI unit 252 illustrated in FIG. 5. For example, an item "automatic charging period settings", as indicated in a screen A1 in FIG. 15, is provided as one of the menu items in the first display unit 254 of the UI unit 252 (see FIG. 5). In the case where an input selecting the "automatic charging period settings" on the basis of this menu screen has been accepted, the processing unit 210 carries out a process for displaying a selection screen, indicated as a screen A2 in FIG. 15, in the first display unit 254.

In the example indicated by the screen A2 in FIG. 15, two modes, namely "set in advance" and "set after viewing remaining ink amount", are provided, and the method for setting the prescribed threshold WTH is switched in accordance with which mode is selected. Here, "set in advance" is a mode for accepting an input based on the aforementioned recognition of "early" or "late" on the part of the user, and in the case where an input selecting "set in advance" has been accepted, the processing unit 210 carries out a process for displaying a selection screen, indicated by a screen A3 in FIG. 15, in the first display unit 254.

As indicated by the screen A3 in FIG. 15, with "set in advance", the user can select one of three periods for the automatic charging, namely "early", "normal", and "late". When "early" is selected in the screen A3 illustrated in FIG. 15, the screen transitions to a screen A4 illustrated in FIG. 15, and the automatic charging will be executed earlier than the normal automatic charging period when "OK" is then pressed. Specifically, the prescribed threshold WTH may be set to a lower value than a normal value (a reference value). For example, in the case where the reference value is 120%, the threshold may be set to a lower first reference value (110%, for example). A user who feels that the automatic charging period is late, as in the above-described case where the printing apparatus 200 is used in high temperatures, can set the automatic charging period to be earlier by selecting "early", which makes it possible to prevent the printing operations from stopping due to excessive use of ink.

When "late" is selected in the screen A3 illustrated in FIG. 15, the screen transitions to a screen A6 illustrated in FIG. 15, and the automatic charging will be executed later than the normal automatic charging period when "OK" is then pressed. Specifically, the prescribed threshold WTH may be set to a higher value than the reference value. For example, in the case where the reference value is 120%, the threshold may be set to a higher second reference value (130%, for example). A user who feels that the automatic charging period is early, as in the above-described case where the printing apparatus 200 is clogged or the like, can set the automatic charging period to be later by selecting "late", which makes it possible to use the entire permitted usage amount (the initial fill amount, for example) of ink.

In the case where an input selecting "normal" is made in the screen A3 illustrated in FIG. 15, the screen transitions to a screen A5 illustrated in FIG. 15, and a setting for returning the prescribed threshold WTH to the reference value may be carried out.

Note that when there are no problems in a normal state, the user setting "early" will result in ink being left over in the ink tank 221, and the user setting "late" will result in the ink in the ink tank 221 running out and the printing operations stopping. In light of this point, in the screen A4 and the screen A6 illustrated in FIG. 15, problems that can arise when setting "early" or "late" are presented in the display screen so that the settings are changed only after catching the user's attention.

Meanwhile, the range across which the prescribed threshold WTH is changed may be set on the basis of a range of tolerance permitted for the estimated consumed ink amount. Here, ±10% is assumed for this range of change, and because the reference value is set to 120%, the prescribed threshold WTH is set within a range of 110 to 130%.

In this manner, the processing unit 210 carries out a process for displaying a menu screen for allowing the user to select the reference value, the first reference value that is lower than the reference value, or the second reference value that is higher than the reference value as the prescribed threshold WTH.

By doing so, a threshold value can be selected from among several reference values set in advance. An appropriate threshold can thus be set through inputs that are easy for the user.

4.2 Set after Viewing Remaining Ink Amount

Although using the above-described "set in advance" makes it possible to make the setting through easy-to-understand and simple user operations, this method does not necessarily make the user confirm the actual consumed ink amount in detail, and it is difficult to set the threshold in a highly accurate manner.

Accordingly, the processing unit 210 may carry out the counting process for finding the estimated consumed ink amount, and may set the prescribed threshold WTH on the basis of the estimated consumed ink amount found through the counting process when it is determined that a predetermined amount of the ink in the ink tank 221 has been consumed.

At its simplest, the amount of ink corresponding to the permitted usage amount information of the memory unit 100 (for example, 1 L, which is the initial fill amount) is taken as the predetermined amount. As described above, the automatic charging being executed at the timing at which the amount of ink corresponding to the permitted usage amount information is used up, without too much ink or not enough ink remaining, is the ideal processing to be realized. As such, the initial fill amount may be taken as the predetermined amount and the result of the counting process when the predetermined amount of ink has been consumed may be used as-is to set the threshold.

For example, in the case where there is no difference between the estimated consumed ink amount based on the counting process and the actual consumed ink amount, the estimated consumed ink amount when the actual consumed ink amount is 1 L is also 1 L, or 117% as described above. In this case, the prescribed threshold WTH may be set to 117%.

In a case of use in high temperatures or the like, the estimated consumed ink amount based on the counting process when 1 L of ink is actually consumed will be less than 117%. For example, 1.1 L of ink is actually consumed at 117%. Thus for the automatic charging to be executed when 1 L of ink is consumed under these conditions (that is, to avoid consuming the 0.1 L), 117%×1 L/1.1 L=106%. In other words, in a case of use in high temperatures or the like, the processing unit 210 setting the prescribed threshold WTH to 106% makes it possible to execute the automatic charging at the timing when 1 L of ink is consumed.

In a case of use when clogging or the like has occurred, the result of the counting process when 1 L of ink is actually consumed will be more than 117%. For example, 0.91 L of ink is actually consumed at 117%. Thus for the automatic charging to be executed when 1 L of ink is consumed under these conditions (that is, to ensure the remaining 0.09 L is consumed), 117%×1 L/0.91 L=129%. In other words, in a case of use when clogging or the like has occurred, the processing unit 210 setting the prescribed threshold WTH to 129% makes it possible to execute the automatic charging at the timing when 1 L of ink is consumed.

Here, the "predetermined amount" is not limited to the amount of ink corresponding to the permitted usage amount information of the memory unit 100 (the permitted usage amount; the initial fill amount), and many variations are possible. For example, the predetermined amount may be 500 mL, in which case doubling the estimated consumed ink amount at which the actual consumed ink amount reaches 500 mL makes it possible to estimate the result of the counting process in the case where the actual consumed ink amount reaches 1 L. In other words, if a ratio between the predetermined amount and the amount of ink corresponding to the permitted usage amount information of the memory unit 100 is known, the result of the counting process in the case where 1 L of ink is actually consumed can be estimated on the basis of that ratio, and an appropriate prescribed threshold WTH can be set. For the sake of simplicity, the following descriptions will assume that the predetermined amount=the amount of ink corresponding to the permitted usage amount information of the memory unit 100=1 L.

However, as described above, the printing apparatus 200 according to this embodiment cannot obtain information of the actual consumed ink amount. As such, it is necessary for the user to provide information indicating that the predetermined amount of ink has actually been consumed between two given points in time.

Accordingly, the processing unit 210 accepts a user input of first input information indicating that the ink in the ink tank 221 is at a first ink amount and a user input of second input information indicating that the ink in the ink tank 221 is at a second ink amount. Then, the processing unit 210 sets the prescribed threshold WTH on the basis of the estimated consumed ink amount found through the counting process in a period from when the input of the first input information is detected to when the input of the second input information is detected.

To allow the input of the first input information and the second input information, the processing unit 210 carries out processes for displaying, in the display unit, a first menu screen for allowing the user to input the first input information and a second menu screen for allowing the user to input the second input information.

For example, a scale (indicator) indicating the remaining ink amount is provided in a part of the ink holding unit 220 visible to the user, in positions corresponding to the first ink amount and the second ink amount. The threshold is then set according to the flow illustrated in FIG. 16.

Figure 16:
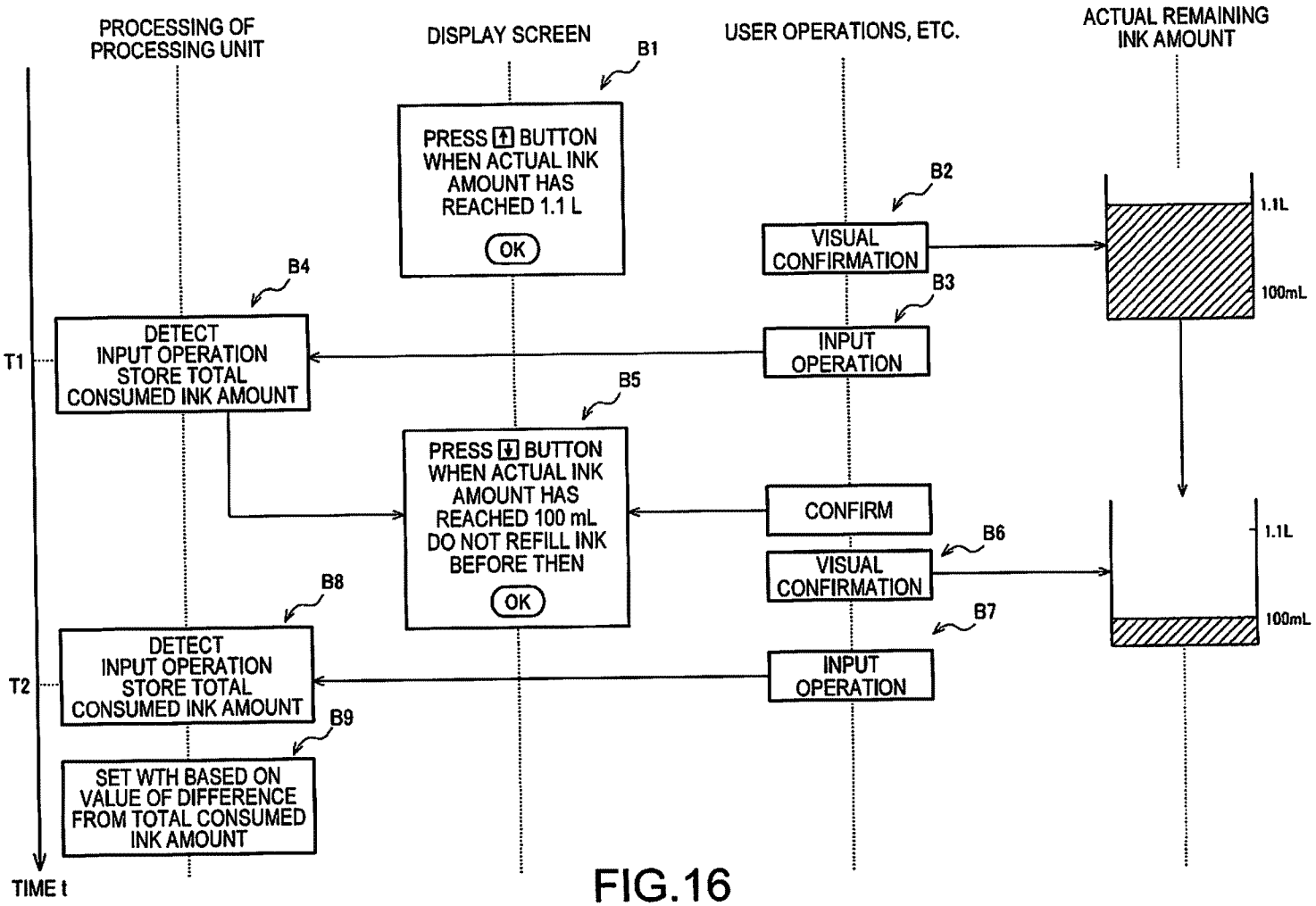
FIG. 16 is a diagram illustrating how processing performed by the processing unit, the display screen, operations performed by a user, and an actual ink amount change over time up until a threshold is set.

FIG. 16 is a diagram illustrating how processing performed by the processing unit 210, the display screen, operations performed by the user, and the actual ink amount change over time up until the threshold is set. As illustrated in FIG. 16, the processing unit 210 carries out a process for displaying a screen indicated by B1 in FIG. 16 in the case where an input for selecting "set after viewing remaining ink amount" has been made in the screen A2 illustrated in FIG.

15. In B1, a display is made instructing the user to make an input in the case where the actual ink amount (actual remaining ink amount) has reached the first ink amount (1.1 L, here), and B1 corresponds to the first menu screen.

The user then visually confirms that the actual ink amount has reached the first ink amount (or ink has been refilled to a position corresponding to the first ink amount), and makes an input (B2, B3). Upon detecting the input as the first input information, the processing unit 210 stores a total estimated consumed ink amount found at that timing (B4).

With the printing apparatus 200 according to this embodiment, the total consumed ink amount, which is the total amount of ink consumed from when the printing apparatus 200 started to be used and is not updated through the charging process, is measured through a counting process, separate from the estimated ink amount information (the estimated consumed ink amount; the total consumed ink amount information WD), as a guideline for a time at which to replace components of the printing apparatus 200. Accordingly, a difference between the total consumed ink amount at the timing at which the first input information is detected (indicated as "T1" hereinafter) and the total consumed ink amount at the timing at which the second input information is detected (indicated as "T2" hereinafter) can be used as a result of a counting process carried out between the two timings T1 and T2 (that is, an estimated consumed ink amount corresponding to a count at the time when the predetermined amount has been consumed).

A process for displaying the screen indicated by B5 is carried out once the total consumed ink amount at T1 has been stored. In B5, a display is made instructing the user to make an input in the case where the actual ink amount has reached the second ink amount (100 mL, here). Furthermore, in B5, a display is made instructing the user not to refill the ink until the second ink amount is reached and an input is made. Here, the processing unit 210 carries out the processing under the condition that the predetermined amount of ink (that is, the first ink amount−the second ink amount) has been consumed between T1 and T2.

In other words, if the ink is refilled during this time, the processing unit 210 will mistakenly assume that ink equivalent to (first ink amount−second ink amount) has been consumed, despite the actual consumed amount being (first ink amount+refill amount−second ink amount), and will be unable to carry out the appropriate processing. The display of B5 is a display for preventing such a situation. B5 corresponds to the second menu screen. Note that after B5 is displayed, the user may be stopped from refilling the ink by additionally displaying text reading "measuring automatic charging period", displaying an icon, or the like.

The user visually confirms that the actual ink amount has reached the second ink amount, and makes an input (B6, B7). Upon detecting the input as the second input information, the processing unit 210 stores the total consumed ink amount found at the timing T2 (B8).

Then, the processing unit 210 takes the value of a difference between the total consumed ink amount stored in B4 and the total consumed ink amount stored in B8 as the estimated consumed ink amount obtained as a result of the counting process between T1 and T2 (B9). In the example illustrated in FIG. 16, the result of this counting process expressed the estimated consumed ink amount in the case where the actual consumed ink amount is the predetermined amount of 1 L, and thus the prescribed threshold WTH can be set on the basis of that result as described above.

Although a specific volume of ink is specified and the user is prompted to make an input in the first menu screen and the second menu screen in FIG. 16, it should be noted that the technique is not limited thereto. For example, in the first menu screen, the user may be instructed to make an input in the case where the ink tank 221 is full of ink. This is because the capacity of the ink tank 221 is determined in the design stage, and the amount of ink in the case where the ink tank 221 is full is therefore already known to the processing unit 210.

Additionally, a screen specifying the position of the scale (for example, "7 cm from bottom surface of tank") may be displayed. Depending on the shape of the ink tank 221, the pitch of the scale may not be constant when using the volume as an indicator, and thus the display of the scale may be indicated as the distance from a reference position such as the bottom surface rather than the volume. In this case, it is the distance information, not the volume of the remaining ink amount, that can be intuitively understood by the user, and thus using distance information as the information specified in the menu screen makes it possible to realize an easily-understandable interface.

Alternatively, a display reading "refill the tank with ink from the ink pack at 7 cm from the bottom surface, and then press ↑" may be made as the first menu screen. In this case, the first ink amount is the sum of the amount of ink at the point in time of "7 cm from the bottom surface of the tank" (100 mL, for example) and the amount of ink contained in the ink pack 310 (1 L, for example), and thus can be seen to be 1.1 L. Additionally, at this time, an input at the timing at which the amount has reached "7 cm from the bottom surface of the tank" may be instructed through the second menu screen. In this case, the stated predetermined amount is the amount of ink contained in the ink pack 310 itself, and thus it is easy to set the predetermined amount as the amount corresponding to the permitted usage amount information of the memory unit 100.

4.3 Variation on Setting after Viewing Remaining Ink Amount

In the setting process based on the first input information and second input information from the user in the above-described "set after viewing remaining ink amount", the first input information and the second input information being inputted at an appropriate timing is considered a prerequisite. Accordingly, the correct setting process cannot be executed if the user has made an erroneous operation.

For example, if operations such as inputting the first input information despite the actual ink amount not being the first ink amount, inputting the second input information despite the actual ink amount not being the second ink amount, or refilling the ink between T1 and T2 regardless of the instructions in B5, the actual consumed ink amount will differ greatly from the stated predetermined amount, and a correct threshold cannot be set.

Accordingly, in this variation, a process for confirming whether or not it is acceptable to use the threshold that has been found is carried out. Specifically, the processing unit 210 carries out a process for comparing the stated predetermined amount with a result of a counting process carried out in a period from when the input of the first input information is detected to when the input of the second input information is detected (specifically, the value of the difference between the total consumed ink amounts), and determines whether or not to set the prescribed threshold WTH on the basis of a result of the comparison process.

With respect to error between the result of the counting process and the actual consumed ink amount, variation is known to be approximately ±10% in the case where the printing apparatus 200 is used at the limits of the environment recommended by the vendor of the printing apparatus 200. In the case where this variation is so great as to exceed the range of tolerance, it can be assumed that some sort of malfunction has occurred. In other words, carrying out the process of comparing the result of the counting process with the stated predetermined amount makes it possible to determine whether an error has occurred, such as whether the user has made a mistaken operation when setting the threshold.

Specifically, in the case where the error between the predetermined amount and the estimated consumed ink amount found through the counting process in the period from when the input of the first input information is detected to when the input of the second input information is detected is less than or equal to a prescribed error, the processing unit 210 sets the prescribed threshold WTH on the basis of the estimated consumed ink amount found through the counting process, whereas in the case where the error between the predetermined amount and the estimated consumed ink amount found through the counting process is greater than the prescribed error, the processing unit 210 does not set the prescribed threshold WTH.

Accordingly, a prescribed threshold WTH found through mistaken operations on the part of the user is not employed, and thus the correct processing can be carried out. As described above, here, the variation may be set on the basis of the tolerance and is, for example, ±20% relative to the reference value (120%). Of course, variations in which stricter conditions than the tolerance or looser conditions than the tolerance are set are also possible, and the stated error may be set from different standpoints.

4.4 Set Viewing Display after Viewing Actual Remaining Ink Amount (Automatic Charging Period Extension)

As described above, the user can know the timing at which to refill the ink on the basis of the number of charge blocks 263 displayed in the estimated remaining ink amount display part 261 of the UI unit 252 illustrated in FIG. 5. Specifically, it is known, on the basis of the counting process, that once a single charge block 263 is displayed in the estimated remaining ink amount display part 261, it is time to refill the ink.

However, the usage environment (high temperature, low temperature, and so on), the usage state (clogging, printing patterns, and so on) of the printing apparatus 200 can cause error to arise between the estimated consumed ink amount in the counting process and the actual consumed ink amount, and the charge blocks 263 displayed in the estimated remaining ink amount display part 261 will instead confuse the user if the number of those blocks no longer corresponds to the actual amount of ink remaining in the ink tank 221.

For example, if the actual consumed ink amount is lower than the estimated consumed ink amount, as in a case of use in low temperatures, a case where clogging has occurred, or the like, there are situations where no charge blocks 263 are displayed in the estimated remaining ink amount display part 261 despite the ink surface being higher than 7 cm from the bottom surface of the ink tank 221, resulting in the automatic charging being executed. To put this differently, in the case where the estimated consumed ink amount has progressed more quickly than the actual consumed ink amount, the timing of the automatic charging will be earlier than the timing at which the ink is refilled on the basis of a visual confirmation of the actual consumed ink amount (called an "ink refill timing" hereinafter).

Figure 17:
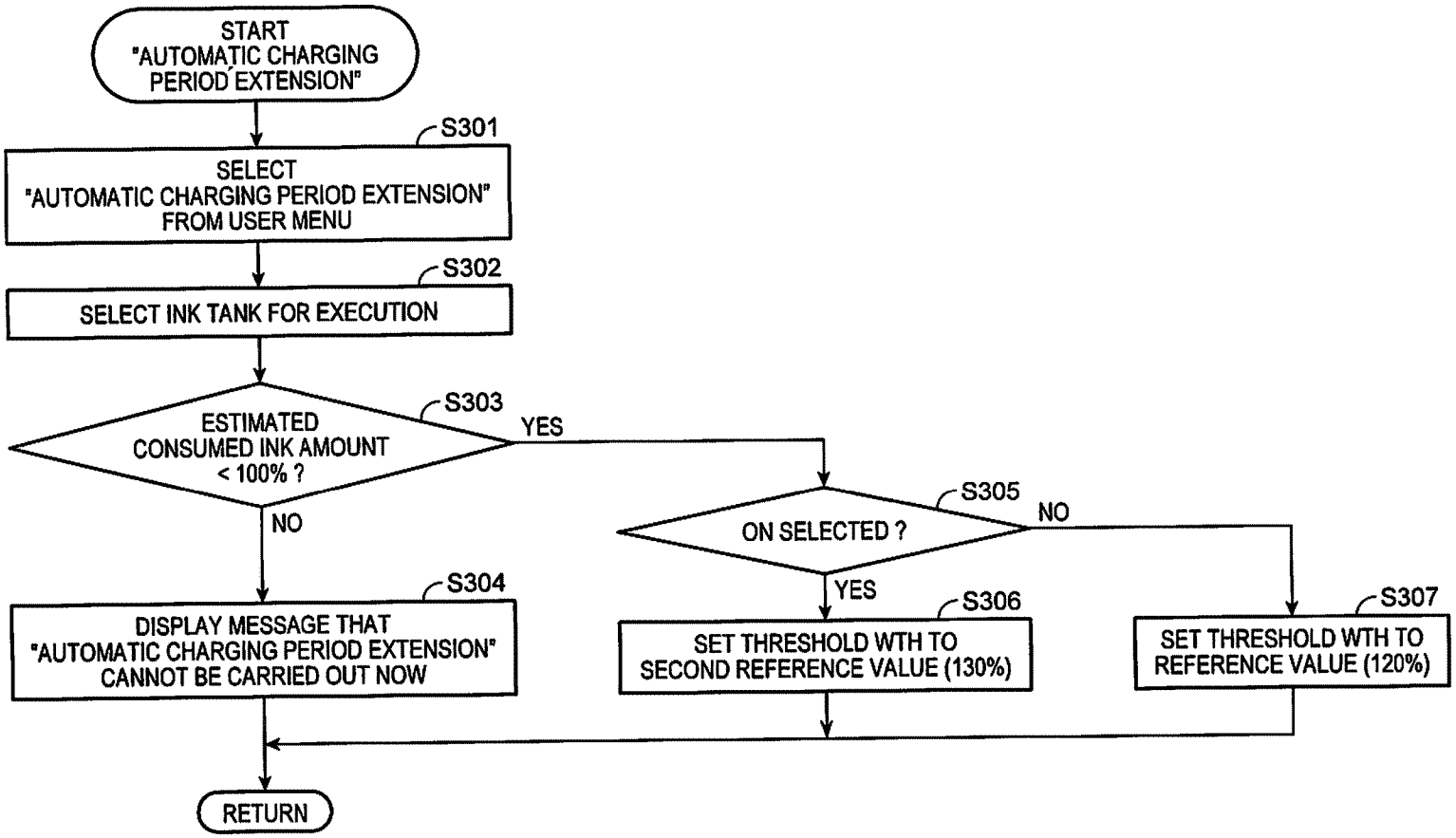
FIG. 17 is a flowchart illustrating an automatic charging period extension process.
Figure 18:
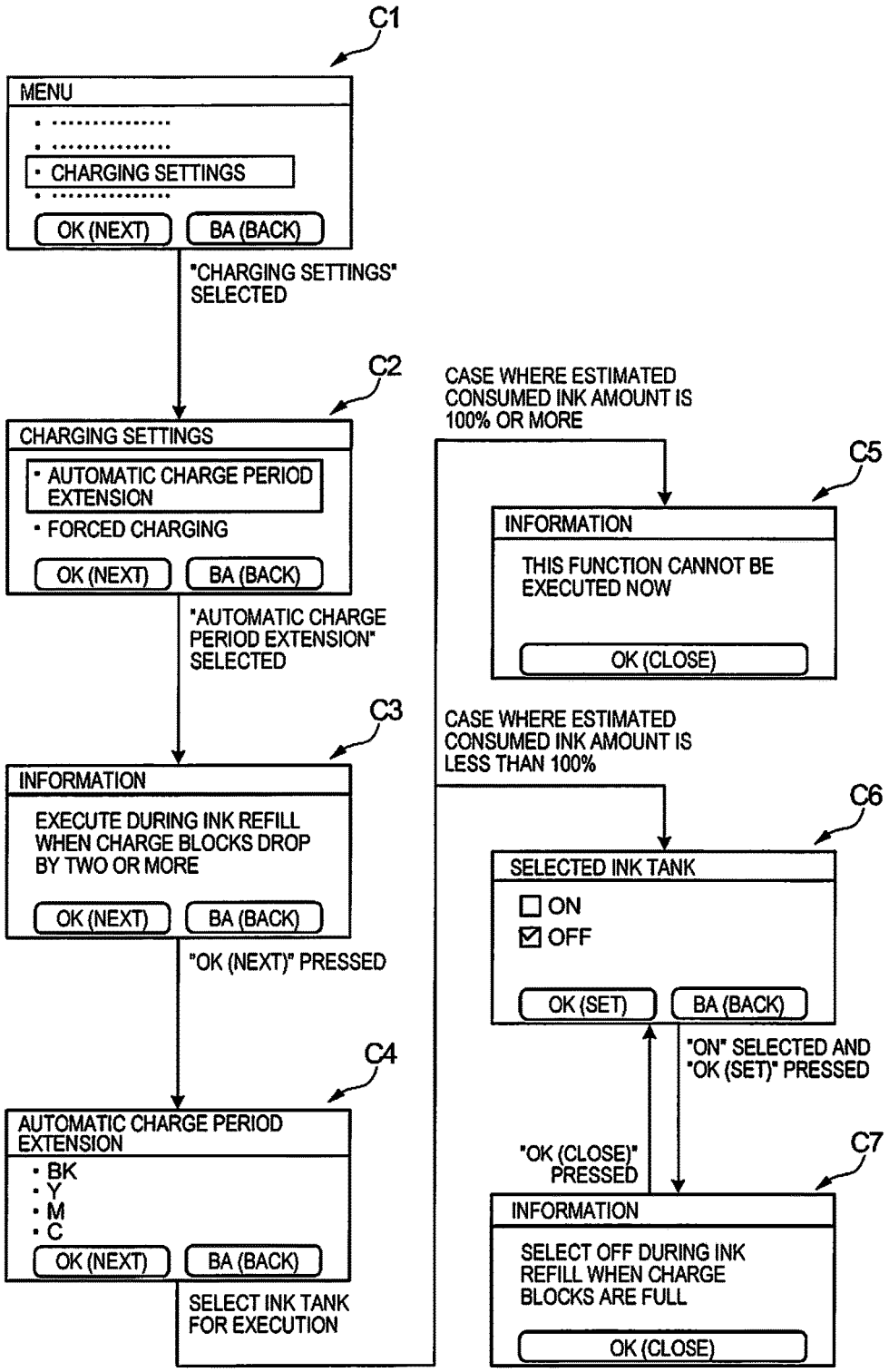
FIG. 18 is a diagram illustrating an example of transitions in a display screen used in the automatic charging period extension process.

In such a case, an "automatic charging period extension (update period extension)" process that delays the timing at which the automatic charging is executed can be executed in the case where there is an instruction from an operator, in order to ensure the timing of the automatic charging matches the ink refill timing. FIG. 17 is a flowchart illustrating the automatic charging period extension process. FIG. 18 is a diagram illustrating an example of transitions in a display screen used in the automatic charging period extension process. Note that the display screens illustrated in FIG. 18 are displayed by the processing unit 210 in the first display unit 254 of the UI unit 252 illustrated in FIG. 5.

As described above, if the ink is to be refilled at an appropriate timing on the basis of the actual consumed ink amount, it is desirable that the ink tank 221 be refilled with ink when the ink surface has been visually confirmed by the user to have reached the lower limit line. Accordingly, the "automatic charging period extension" process is a process recommended for a user to execute when ink is consumed following the execution of the automatic charging process and the ink surface has been visually confirmed to have reached a position of 7 cm from the bottom surface of the ink tank 221.

In actuality, the printing apparatus 200 does not detect the ink surface reaching the position 7 cm from the bottom surface of the ink tank 221, and furthermore, it is unclear, from the perspective of the printing apparatus 200, whether or not the user has visually confirmed that position. Accordingly, the automatic charging period extension process is started by the user selecting that process to be executed from a menu screen.

However, it is assumed that the "automatic charging period extension" process can be executed in the case where, based on the counting process, a certain amount of ink has been consumed (the number of the charge blocks 263 is less than or equal to four) and the estimated consumed ink amount is less than 100% (the number of the charge blocks 263 is greater than or equal to two).

Accordingly, the "automatic charging period extension" process illustrated in the flowchart of FIG. 17 is started in response to a user operation in the case where the user executes printing operations of the printing apparatus 200 and the number of the charge blocks 263 displayed in the estimated remaining ink amount display part 261 is greater than or equal to two and less than or equal to four.

First, in step S301 of FIG. 17, the user selects "charge settings" from a user menu screen indicated by a screen C1 in FIG. 18, and selects "automatic charging period extension" from a charge setting menu screen indicated by a screen C2. Then, information indicating "execute when refilling the ink when the charge blocks have dropped by two or more" is displayed for the user in a screen C3. This information is for ensuring the user confirms that the number of the charge blocks 263 displayed in the estimated remaining ink amount display part 261 is less than or equal to four, and the screen transitions to a screen C4 upon the user pressing "OK (next)".

Next, in step S302 of FIG. 17, the user selects the ink tank 221 for which the automatic charging period extension is to be executed from the screen C4 illustrated in FIG. 18. Although the screen C4 illustrated in FIG. 18 is a selection screen for a case where there is a single ink tank 221 for each ink color, a selection screen for each ink tank 221 is displayed in the screen C4 in the case where there are a plurality of ink tanks 221 for each ink color.

Upon the user selecting the target ink tank 221, the process moves to step S303 of FIG. 17, where the processing unit 210 (see FIG. 11) determines whether or not the consumed ink amount estimated by the processing unit 210 for the target ink tank 221 is less than 100%.

In the case where the estimated consumed ink amount is greater than or equal to 100% in step S303 of FIG. 17 (step S303: NO), the process moves to step S304, where the processing unit 210 displays information indicating that the automatic charging period extension cannot be executed, such as "this function cannot be executed at this time", indicated in a screen C5 in FIG. 18. This is because in this case, the estimated consumed ink amount is greater than or equal to 100% based on the user having visually confirmed the ink surface reaching a position 7 cm from the bottom surface of the ink tank 221, and thus it cannot be said that the estimated consumed ink amount has progressed further than the actual consumed ink amount.

In the case where the estimated consumed ink amount is less than 100% in step S303 of FIG. 17 (step S303: YES), the processing unit 210 transitions to a display screen for selecting whether to turn the automatic charging period extension on or off, indicated by a screen C6 in FIG. 18, and then determines whether or not the user has selected "on" (step S305 of FIG. 17). "Off" (that is, the automatic charging period extension will not be executed) is set as a default, as indicated by the screen C6.

In the case where the user has selected "on" (that is, to execute the automatic charging period extension) and pressed "OK" in the screen C6 illustrated in FIG. 18 (step S305: YES), the processing unit 210 moves to step S306 of FIG. 17 and changes the prescribed threshold WTH to the second reference value (130%), for example. As a result, the timing of the automatic charging executed next will be later than in the case where the prescribed threshold WTH is the reference value (120%).

Meanwhile, in the case where the user has selected "on" in the screen C6 illustrated in FIG. 18 (step S305: YES), the information indicated in a screen C7 is displayed. The information indicated in the screen C7 is information for prompting the user to set the automatic charging period extension, which had been on, to off, in the case where the number of charge blocks 263 is full (five or more) when the ink surface has reached a position 7 cm from the bottom surface of the ink tank 221.

If the automatic charging is repeated with the automatic charging period extension remaining set (that is, with "on" remaining selected), there are cases in which not only has the estimated consumed ink amount no longer progressed further than the actual consumed ink amount, but the timing of the automatic charging is also delayed relative to the ink refill timing.

For example, if despite the ink surface having reached the position 7 cm from the bottom surface of the ink tank 221, the estimated consumed ink amount cannot keep up with the actual consumed ink amount and five or more of the charge blocks 263 are displayed in the estimated remaining ink amount display part 261, the user may become confused. When such a state has arisen, the user can cancel the automatic charging period extension setting by making operations from the screen C1 illustrated in FIG. 18 and selecting "off" in the screen C6.

In the case where the user has selected "off" (that is, to not execute the automatic charging period extension) and pressed "OK" in the screen C6 illustrated in FIG. 18 (step S305: NO), the processing unit 210 moves to step S307 of FIG. 17 and changes the prescribed threshold WTH to the reference value (120%). As a result, the automatic charging period extension setting is cancelled, which makes it possible to eliminate delay in the timing of the automatic charging relative to the ink refill timing.

4.5 Execute Charge Having Viewed Display after Viewing Remaining Ink Amount (Forced Charging)

In the "automatic charging period extension" described above, if, due to the actual consumed ink amount being lower than the estimated consumed ink amount in a case of use in low temperatures, a case where clogging or the like has occurred, and so on, the timing of the automatic charging will be earlier than the ink refill timing, it is possible to delay the timing of the automatic charging.

On the other hand, if the actual consumed ink amount is greater than the estimated consumed ink amount due to use in high temperatures, printing patterns, or the like, the number of the charge blocks 263 displayed in the estimated remaining ink amount display part 261 will be greater than the actual remaining ink amount, and there are thus cases where the automatic charging cannot be executed despite the ink surface having reached or dropped below 7 cm from the bottom surface of the ink tank 221. To rephrase, in the case where the actual consumed ink amount has progressed further than the estimated consumed ink amount, the timing of the automatic charging will be later than the ink refill timing.

If, in such a state, the user fails to visually confirm the actual remaining ink amount, determines that there is still ink on the basis of the number of the charge blocks 263 displayed in the estimated remaining ink amount display part 261, and continues the printing operations, there are cases where the ink will run out, the sensor will detect that there is no ink, and the operations of the printing apparatus 200 will stop.

Meanwhile, in the case where the automatic charging is repeated with the above-described "automatic charging period extension" remaining set and the timing of the automatic charging has become later than the ink refill timing, it can be difficult to eliminate the delay of the timing of the automatic charging relative to the ink refill timing simply by canceling the automatic charging period extension setting.

In such a case, a "forced charging" process that forcefully executes the charging process and discards the current charged state can be executed in response to an instruction from the operator in order to align the timing of the automatic charging with the ink refill timing.

Figure 19:
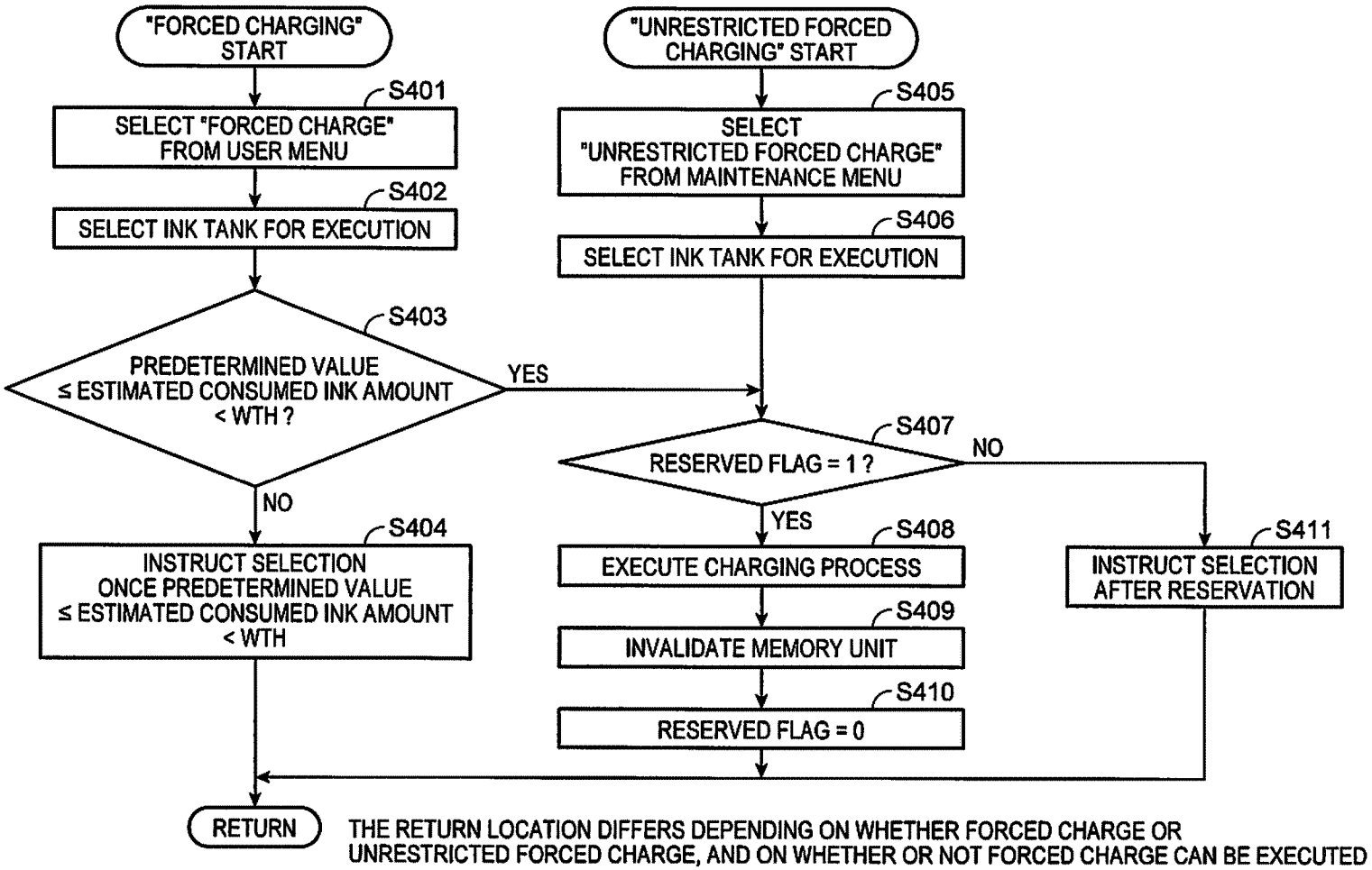
FIG. 19 is a flowchart illustrating a forced charging process.
Figure 20:
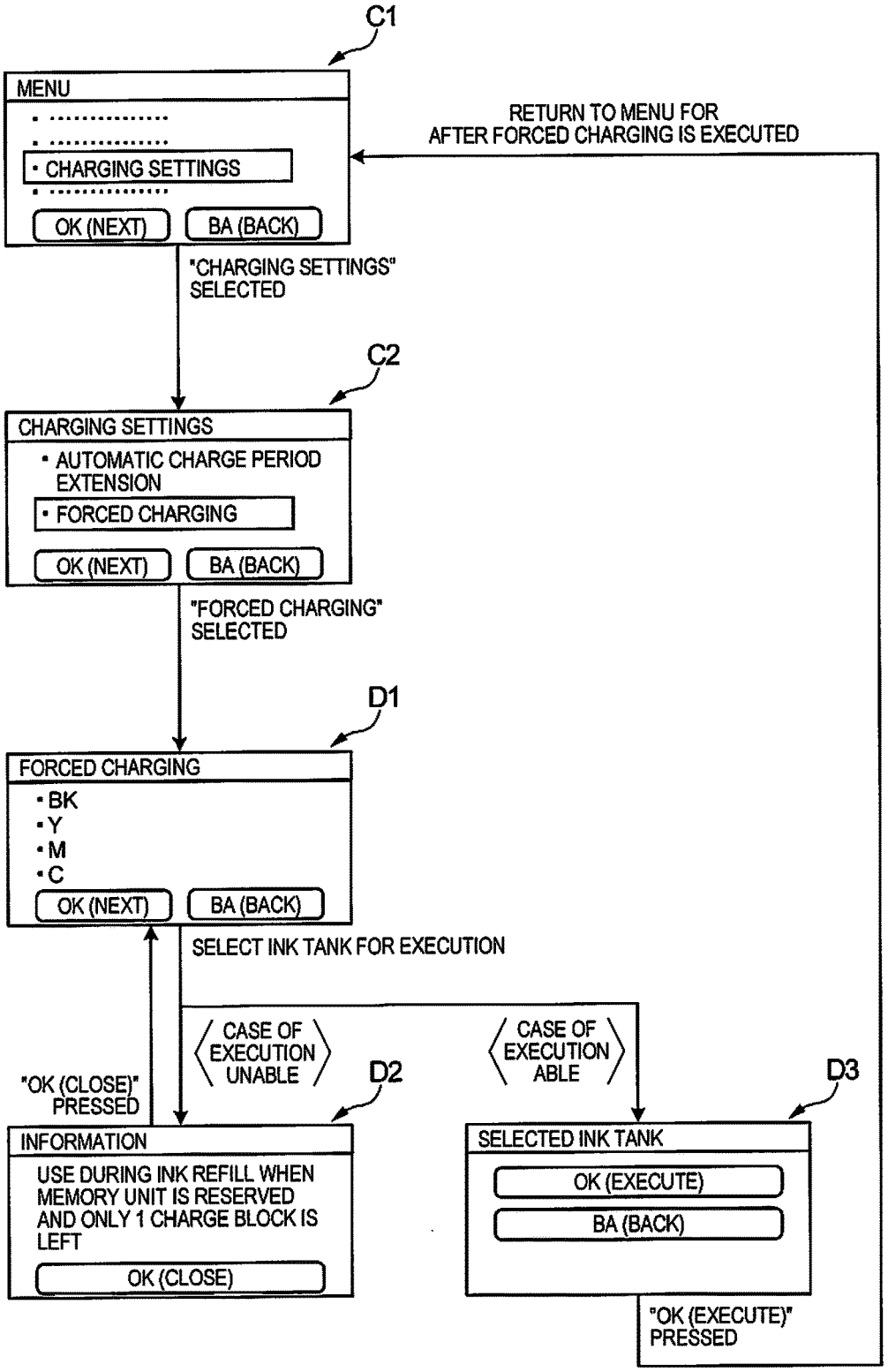
FIG. 20 is a diagram illustrating an example of transitions in a display screen used in a user-oriented forced charging process.
Figure 21:
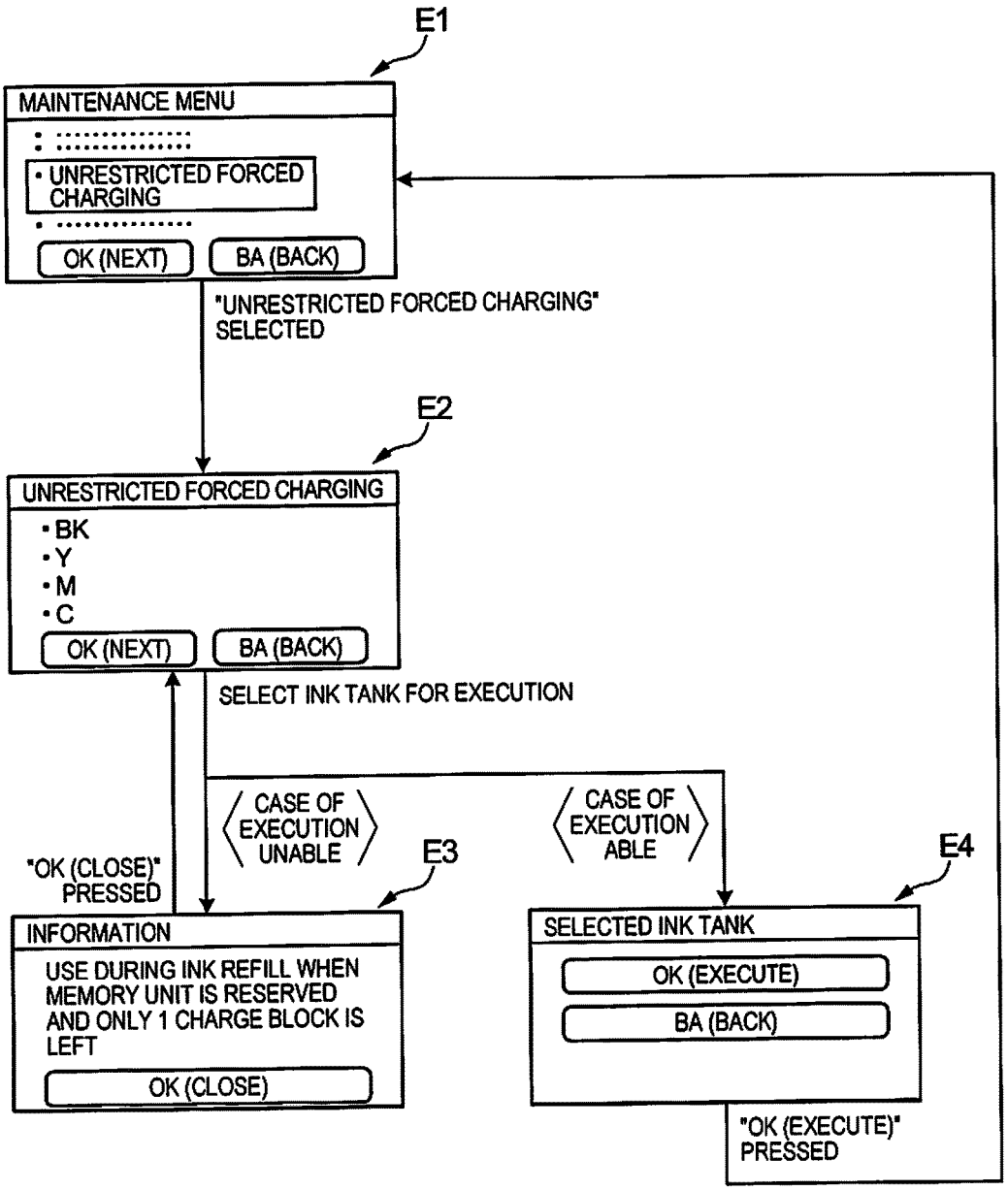
FIG. 21 is a diagram illustrating an example of transitions in a display screen used in a maintenance-oriented forced charging process.

FIG. 19 is a flowchart illustrating the forced charging process. The processes illustrated in FIG. 19 are processes executed by the processing unit 210 of the printing apparatus 200. FIG. 20 is a diagram illustrating an example of transitions in a display screen used in a user-oriented forced charging process. FIG. 21 is a diagram illustrating an example of transitions in a display screen used in a maintenance-oriented forced charging process. Note that the display screens illustrated in FIGS. 20 and 21 are displayed by the processing unit 210 in the first display unit 254 of the UI unit 252 illustrated in FIG. 5.

The user-oriented forced charging process is a process recommended to be executed in response to user instructions when the ink surface is visually confirmed to have reached the position of 7 cm from the bottom surface of the ink tank 221, prior to the execution of the automatic charging process. The forced charging process is a process for charging from a new memory unit 100 (the second memory unit 100-2), and thus a reserved state is a prerequisite.

However, if the user executes the forced charging process carelessly without visually confirming that the ink surface has reached the position of 7 cm from the bottom surface of the ink tank 221, the estimated ink amount information based on the permitted usage amount information of the ink charged using the current first memory unit 100-1 will be discarded. There is thus a risk that despite there being an estimated consumed ink amount, the actual ink corresponding to that estimated consumed ink amount will not be completely consumed. Accordingly, it is assumed that the forced charging process can be executed upon the estimated consumed ink amount being greater than or equal to a predetermined value that is lower than the prescribed threshold WTH.

In this embodiment, the prescribed threshold WTH is assumed to be the reference value of 120%, whereas the predetermined value that is lower than the prescribed threshold WTH is assumed to be 100%. Accordingly, the user can execute the forced charging process when the estimated consumed ink amount estimated by the processing unit 210 (see FIG. 11) for the target ink tank 221 is greater than or equal to the predetermined value of 100% and less than the prescribed threshold WTH of 120%. When the estimated consumed ink amount is greater than or equal to 100% and less than 120%, a single charge block 263 is displayed in the estimated remaining ink amount display part 261.

Here, when the vendor of the printing apparatus carries out maintenance or repairs on the printing apparatus 200, there are cases where it is necessary to execute the forced charging process regardless of the value of the consumed ink amount (that is, regardless of the estimated ink amount information, the actual remaining ink amount, and so on). For example, in the case where an ink tank 221 that has been left for a long period of time so that the ink therein as degraded is to be discarded and replaced, it is necessary to first discard the charged estimated ink amount information.

In such a case, it is assumed that the forced charging process (called "unrestricted forced charging" hereinafter) can be executed regardless of whether or not the estimated consumed ink amount is greater than or equal to 100% and less than 120% in the case where there is an instruction from a technician who carries out the maintenance or repairs (called a "maintenance worker" hereinafter). Accordingly, the configuration is such that the operator that executes the "unrestricted forced charging" process can be restricted to the maintenance worker.

First, the "forced charging" process executed by the user will be described. The "forced charging" process indicated in the flowchart of FIG. 19 is a process recommended to be started in response to an operation (instruction) from a user serving as the operator of the printing apparatus 200, in the case where a single charge block 263 is displayed in the estimated remaining ink amount display part 261 when the ink surface has been visually confirmed to be at the position of 7 cm from the bottom surface of the ink tank 221 prior to executing the automatic charging process in a reserved state. In actuality, the printing apparatus 200 does not detect the ink surface reaching the position 7 cm from the bottom surface of the ink tank 221, and thus the forced charging process is started by the user selecting that process to be executed from a menu screen.

In step S401 of FIG. 19, the user selects "charge settings" from the menu screen indicated by the screen C1 in FIG. 20, and selects "forced charging" from the charge settings menu screen indicated by the screen C2. Note that in this embodiment, the screens C1 and C2 in FIG. 20 are the same as the screens C1 and C2 in FIG. 18. The screen transitions to a screen D1 upon the user selecting "forced charging" in the screen C2.

In step S402 of FIG. 19, the user selects the ink tank 221 for which the forced charging is to be executed, from the screen D1 in FIG. 20. Although the screen D1 illustrated in FIG. 20 is a selection screen for a case where there is a single ink tank 221 for each ink color, a selection screen for each ink tank 221 is displayed in the screen D1 in the case where there are a plurality of ink tanks 221 for each ink color.

Upon the user selecting the target ink tank 221, the processing unit 210 moves the process to step S403 of FIG. 19, and determines whether or not the estimated consumed ink amount for the target ink tank 221 is greater than or equal to the predetermined value (100%) and less than the prescribed threshold WTH (120%). This is the same as confirming that a single charge block 263 is displayed in the estimated remaining ink amount display part 261.

In the case where the estimated consumed ink amount is less than a predetermined value or is greater than or equal to the prescribed threshold WTH in step S403 of FIG. 19 (step S403: NO), the forced charging cannot be executed. Accordingly, the processing unit 210 moves the process to step S404, where information indicating that the forced charging cannot be executed, such as "please use this function when one charge block is left during chip unit (memory unit) reservation when refilling ink" indicated in a screen D2 of FIG. 20 (an "execution unable" case), is displayed. Through this, the user can be notified of the reason why the forced charging cannot be executed. When the user presses OK (close) in the screen D2, the display screen of the first display unit 254 returns to the display screen D1 illustrated in FIG. 20.

In the case where the estimated consumed ink amount is greater than or equal to the predetermined value and is less than the prescribed threshold WTH in step S403 of FIG. 19 (step S403: YES), the forced charging can be executed. Accordingly, the processing unit 210 moves the process to step S407, and determines whether or not the current state is a reserved state (that is, whether or not the reserved flag is 1).

In the case where the current state is the reserved state (that is, the reserved flag is 1) in step S407 of FIG. 19 (step S407: YES), the forced charging can be executed. Accordingly, the processing unit 210 prompts the user to confirm whether or not to execute the forced charging, as indicated in a screen D3 illustrated in FIG. 20. This is to prevent the user from carelessly executing the forced charging process.

Upon the user pressing OK (execute) in the screen D3 illustrated in FIG. 20, the processing unit 210 moves the process to step S408 of FIG. 19 and executes the charging process, invalidates the memory unit 100 that had been reserved (step S409), and sets the reserved flag to 0 (step S410). As a result, the display screen of the first display unit 254 returns to the display screen C1 illustrated in FIG. 20.

In the case where the current state is not the reserved state (that is, the reserved flag is 0) in step S407 of FIG. 19 (step S407: NO), the forced charging cannot be executed. Accordingly, in step S411, the processing unit 210 displays information prompting the user to start the forced charging process after making a reservation. This information may be the same information as that indicated in the screen D2 illustrated in FIG. 20.

In the above-described forced charging process, it is necessary to return from the screen D2 in FIG. 20 to the screen D1, and for the user to once again select an ink tank 221, if the charge blocks 263 have not yet reached a single block (that is, if the estimated consumed ink amount is less than the predetermined value) after the ink surface has been visually confirmed to have reached the position of 7 cm from the bottom surface of the ink tank 221. However, the invention is not limited to this embodiment, and for example, the user may be able to select an ink tank 221 even if the estimated consumed ink amount is less than a predetermined value, and the estimated consumed ink amount of the selected ink tank 221 reaching or exceeding the prescribed predetermined value may then be displayed. Doing so makes it possible for the user to execute the forced charging process without re-selecting the ink tank 221.

Next, the "unrestricted forced charging" process executed by the maintenance worker will be described. The printing apparatus 200 is provided with a maintenance menu, separate from the user-oriented menu, for executing the "unrestricted forced charging" process. The maintenance menu is displayed in the first display unit 254 of the UI unit 252 in response to a specific operation, such as a plurality of buttons being pressed simultaneously, in order to prevent a typical user from carelessly executing the unrestricted forced charging process.

The "unrestricted forced charging" process illustrated in the flowchart of FIG. 19 is started in response to an operation (instruction) from the maintenance menu for the maintenance worker, who serves as the operator of the printing apparatus 200. In step S405 in FIG. 19, the maintenance worker selects "unrestricted forced charging" from a maintenance menu screen indicated by a screen E1 in FIG. 21. The screen transitions to a screen E2 upon the maintenance worker selecting "unrestricted forced charging" in the screen E1.

In step S406 of FIG. 19, the maintenance worker selects the ink tank 221 for which the unrestricted forced charging is to be executed, from the screen E2 in FIG. 21. Because the unrestricted forced charging process can be executed regardless of the magnitude of the estimated consumed ink amount, once an ink tank 221 is selected in step S406, the processing unit 210 moves the process to step S407, and determines whether or not the current state is a reserved state (that is, whether or not the reserved flag is 1).

The processing steps from step S407 on in the unrestricted forced charging are the same as in the user-oriented forced charging. In the case where the state is a reserved state and the execution is possible (step S407: YES), the processing unit 210 uses a screen E4 illustrated in FIG. 21 to confirm with the maintenance worker whether or not the forced charging is to be executed, and the charging process is executed upon the maintenance worker pressing OK (execute). As a result, the display screen of the first display unit 254 returns to the display screen E1 illustrated in FIG. 21. In the case where the state is not the reserved state (step S407: NO), the processing unit 210 displays information indicated in a screen E3 illustrated in FIG. 21.

Although not illustrated in the flowchart of FIG. 19, in the case where the maintenance worker has executed the unrestricted forced charging process from the maintenance menu, the processing unit 210 stores, in the storage unit 212, information that enables the day on which the unrestricted forced charging process was executed to be identified (for example, a year, month, and day). Doing so makes it possible to identify the day on which the maintenance worker perform maintenance, repairs, or the like on the printing apparatus 200, and thus it is possible to track the occurrence of problems in the printing apparatus 200, whether or not the user has misused the printing apparatus 200, or the like as necessary.

For example, in the case where the unrestricted forced charging process has been executed repeatedly in a comparatively short amount of time, it is possible that some sort of problem has arisen in the printing apparatus 200. Additionally, in the case where maintenance or repair records recorded separately indicate that no maintenance or repairs were carried out on a day when the unrestricted forced charging process was executed, it is conceivable that the user may have misused the printing apparatus, and thus feedback can be given to the user as necessary.

In the setting processes for reducing error described above, a plurality of working examples, from 4.1 to 4.5, have been given. However, the embodiment may be configured such that only the working example of the forced charging in 4.5 can be executed, or may be configured such that the forced charging in 4.5 and another working example can be executed. Alternatively, the configuration may be such that all of the working examples can be executed.

5. Variations

The embodiment described above merely indicates a single aspect of the invention, and other desired variations and applications are possible within the scope of the invention. Several such variations will be described hereinafter.

Although the embodiment describes a case where there is an area for storing whether the memory unit 100 is valid or invalid in the storage device 110 thereof as an example, a variety of methods for setting the memory unit 100 to invalid can be considered. For example, in the case where the charging process has been carried out using the memory unit 100, the processing unit 210 may invalidate the memory unit by writing invalidating data into a region, of the storage region in the memory unit 100, where the permitted usage amount information is stored. For example, in the case where the permitted usage amount information is stored as the memory unit-side consumed ink amount (information indicating 0% when in an unused state), a value at which the value corresponding to the initial fill amount (117%) will be exceeded may be written into that storage region. Doing so makes it possible to invalidate the memory unit 100 using the storage region for the permitted usage amount information. However, the method of invalidation is not limited thereto, and rather than the region (address) where the permitted usage amount information is stored, a region that stores a valid flag (invalid flag) may be provided, and the memory unit 100 may be invalidated by overwriting the data in that region with a value corresponding to the invalid state.

Note that the storage region of the memory unit 100 may be managed using addresses. For example, ID information of the memory unit 100 may be stored using 8 bits of a storage region corresponding to an address ad1 (for example, a region that takes ad1 as a starting address), color information expressing the color of the ink may be stored using 2 bits of a storage region corresponding to an address ad2, and the permitted usage amount information may be stored using 8 bits of a storage region corresponding to an address ad3. In the case where the permitted usage amount information is expressed by the initial fill amount and the consumed ink amount relative to the initial fill amount, the region for storing the permitted usage amount information may be divided into two regions, with the first region storing the initial fill amount and the second region storing the consumed ink amount.

Additionally, although the embodiment describes the permitted usage amount information of the memory unit 100 as including the initial fill amount and the consumed ink amount relative to the initial fill amount, and describes the estimated ink amount information of the printing apparatus 200 as including the total consumed ink amount information WD and the initial fill amount, these pieces of information are not limited thereto. For example, information regarding a remaining amount may be employed instead of information regarding a consumed amount. Specifically, an amount of ink, from the initial fill amount, that is estimated to remain without being used may be employed. In the case where the remaining ink amount is employed instead of the consumed ink amount information, content reading "exceeds the prescribed threshold" in the embodiment may be replaced with "drops below the prescribed threshold".

Here, the remaining ink amount is, for example, information expressed as a volume. In this case, the amount of ink that can be used can be directly understood as a volume, a weight, or the like simply by referring to the remaining ink amount, without needing to refer to the initial fill amount. Accordingly, updating the estimated ink amount information using the permitted usage amount information (that is, the charging process) is realized using the remaining ink amount indicated by the permitted usage amount information, through a process for replacing the remaining ink amount indicated by the permitted usage amount information.

Meanwhile, the remaining ink amount may be information expressing a percentage of the remaining amount relative to the initial fill amount. In this case, the charging process is a process that updates the estimated ink amount information in the printing apparatus 200 using both the initial fill amount and the remaining ink amount in the permitted usage amount information.

Additionally, the initial fill amount in the embodiment may be expressed as a volume or as a weight. Likewise, the consumed ink amount and the remaining ink amount are not limited to being expressed as percentages or volumes, and can instead be expressed as weights.

Additionally, in the embodiment, the consumed ink amount estimated for when the initial fill amount is consumed is expressed as 100% assuming that the ink consumption efficiency is a lower limit value of a predetermined range and the printing apparatus is used in a usage environment recommended by the printing apparatus vendor. However, the reference in the case where the consumed ink amount is expressed as a percentage is not limited thereto, and many variations are possible. For example, the reference may be set to a lower value than the initial fill amount in the case where a warning display is carried out sufficiently in advance.

Additionally, a variety of forms of information can be used with respect to the information used by the processing unit 210 when finding the estimated ink amount information (estimated consumed ink amount). The processing unit 210 may use a soft counting process to count the number of ink ejections and then take the counted number as the estimated ink amount information, or information obtained by multiplying the count number by the amount of ink assumed to be consumed in a single ejection, or in other words, information expressing the volume of the ejected ink, may be used as the estimated ink amount information. In either case, the estimated ink amount information is information expressing how much of the ink in question is used.

In addition, in the embodiment, information of the initial fill amount is held in the memory unit 100 and the printing apparatus 200 in consideration of cases where there is variation in the amounts of ink held in the ink packs 310, cases where multiple sizes of ink packs 310 (for example, 1 L, 2 L, and so on) are present, and so on. However, the initial fill amount may be taken as a fixed value in the case where the ink packs 310 have only a predetermined volume and there is no need to take such a variation into consideration. In this case, storing the initial fill amount, which is a fixed value, in all of the memory units 100 included with the ink packs 310 has no great meaning. Accordingly, the initial fill amount (the ink pack volume) and a percentage corresponding to the initial fill amount can be stored in the storage unit 212 of the printing apparatus 200 in advance. As a result, the initial fill amount can be left out of the permitted usage amount information of the memory unit 100. In this case, it is not necessary to consider the update (replacement) of the initial fill amount in the charging process, and the update (replacement) may be carried out using the consumed ink amount (remaining ink amount).

Additionally, a situation in which a partially-used memory unit 100, specifically a memory unit 100 in which the consumed ink amount is greater than an unused state (0%) but is less than the value corresponding to the initial fill amount (WTH %, for example), is attached can also be considered in the embodiment. Such a memory unit 100 can arise in the case where, for example, the technique according to JP-A-2014-46545 is also employed. In the embodiment, the consumed ink amount from the memory unit 100 is used in the charging process, and thus the correct processing is possible regardless of whether the memory unit 100 is unused or is partially used.

However, there are also cases where it is assumed that new, valid memory units 100 will always be used. For example, with the technique according to the embodiment, a memory unit 100 that has undergone the charging process is invalidated, and thus there are no memory units 100 that are both valid and for which the consumed ink amount is between 0% and WTH %. In other words, only two types of memory unit 100 can be considered, namely one that is both new and valid, and one that is invalid. In this case, the consumed ink amount for a valid memory unit 100 will always reach 0%, and thus there is no great meaning in storing the consumed ink amount in all of the memory units 100 included with the ink packs 310. Accordingly, the consumed ink amount may be omitted from the permitted usage amount information, and only the initial fill amount may be used, in the embodiment.

It is also possible to omit both the initial fill amount and the consumed ink amount in the case where the initial fill amount is set in the printing apparatus 200 in advance and it is assumed that a new, valid memory unit 100 will always be used. As long as the memory unit 100 can be confirmed as valid, the estimated ink information may be charged (that is, the consumed ink amount may be reset), and thus the permitted usage amount information in this case may be any information enabling the memory unit 100 to be confirmed as valid.

Additionally, as described above using FIG. 3, a plurality of ink tanks 221, slots 230, memory units 100, and sliders 240 have been described, assuming a printing apparatus 200 carries out color printing. However, if the printing apparatus 200 carries out black-and-white printing, only a single ink tank 221, slot 230, memory unit 100, and slider 240 may be provided.

Additionally, although the embodiment describes stopping printing operations upon the sensor that detects the presence/absence of ink detecting that there is no ink, the invention is not limited thereto, and the printing operations may be stopped in the case where the processing unit 210 has carried out a predetermined number of counting processes after the sensor has detected that there is no ink (that is, in the case where the soft count has reached or exceeded a prescribed threshold). Meanwhile, after the printing operations have been stopped on the basis of the sensor detecting that there is no ink, the printing apparatus 200 restores the printing operations to the pre-stopped state upon the sensor detecting that there is ink. For example, the charged flag and the reserved flag are set to the values present before the printing operations were stopped. In the example illustrated in the state transition diagram of FIG. 14, the sensor detects that there is no ink during printing operations, and it is thus possible that the printing operations will be stopped by the sensor in each of the states from state S1 to state S6. In this case, the state moves from a state Si (where i is an integer fulfilling the relationship $1 \leq i \leq 6$) to a printing stopped state (not shown), and the state Si, which is the state before the stop, is held (for example, stored in the storage unit 212); then, a process for moving from the printing stopped state to the state Si is carried out when ink is detected.

Additionally, the method for detecting the attachment of the memory unit 100 is not limited to that illustrated in FIG. 11. For example, the memory unit 100 may be provided with two attachment detection terminals that are electrically connected, and the attachment may be detected by the processing unit 210 detecting electrical conduction between two main unit-side (slot-side) attachment detection terminals corresponding to the stated two attachment detection terminals.

Additionally, the method through which the processing unit 210 selects the memory unit 100 to be accessed is not limited to that described in the embodiment above. For example, if a configuration in which the processing unit 210 outputs the clock signal SCK to each slot 230 individually is employed, a prescribed memory unit 100 can be selected by outputting the clock signal SCK only to that memory unit 100. Alternatively, if a configuration in which the processing unit 210 inputs and outputs the data signal SDA to and from the slots 230 individually is employed, a prescribed memory unit 100 can be selected by outputting the data signal SDA (for example, a readout command or the like) only to that memory unit 100.

Additionally, the ink refilling receptacle is not limited to the ink pack 310. For example, the ink refilling receptacle may be a receptacle that uses a hard member formed from a resin or the like. Even in such a case, it is sufficient that the ink refilling receptacle last until being used to refill the ink tank 221 with ink, and there is no difference with respect to the ability to lower the requirements for durability or the like compared to the ink tank 221. Note that in the case where the ink pack 310 (a pouch) is used, it is assumed to be necessary to use all of the ink contained therein to fill the ink tank 221 once the pack has been opened. To rephrase, once the ink pack 310 is opened, it is difficult to use the ink pack 310 to properly store ink. However, in the case where a hard member is used for the ink refilling receptacle and a cap can be provided in the refilling receptacle itself, the ink can be refilled in multiple instances.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms that have broader or the same definitions as terms that have been used once and that are denoted along with the stated terms can be replaced with those terms in all areas of the specification or drawings. Furthermore, the configurations and operations of the printing apparatus 200 are not intended to be limited to the embodiment, and many variations thereon are possible as well.

This application claims the benefit of foreign priority to Japanese Patent Applications No. JP2016-77878, filed Apr. 8, 2016, No. 2015-238447, filed Dec. 7, 2015, No. JP2015-238450, filed Dec. 7, 2015, and No. 2016-090385, filed Apr. 28, 2016, which are incorporated by reference in their entirety.

What is claimed is:

1. A printing apparatus comprising:

a slot configured such that each of memory units storing permitted usage amount information of ink is attached to the slot and removed from the slot; and a processing unit configured to carry out a process to update estimated ink amount information that is information to estimate an amount of ink in an ink holding unit to be consumed in the printing apparatus, the estimated ink amount information expressing a total consumed ink amount consumed in the printing apparatus which is calculated relative to an initial fill amount of ink, wherein the processing unit is further configured to execute, in a state where a current memory unit is attached to the slot, an updating process that updates the estimated ink amount information using the permitted usage amount information stored in the current memory unit based on a process to determine whether or not the consumed ink amount expressed by the estimated ink amount information exceeds a prescribed threshold which is the permitted usage amount information, and to execute a forced updating process that executes the updating process in a case where there is an instruction from an operator before the prescribed threshold is exceeded.

2. The printing apparatus according to claim 1, wherein in a case where the instruction is inputted from a menu for a user of the printing apparatus, the processing unit is further configured to execute the forced updating process when the consumed ink amount is greater than or equal to a predetermined value that is lower than the prescribed threshold.

3. The printing apparatus according to claim 2, further comprising:

a user interface unit, wherein the processing unit displays the menu in the user interface unit.

4. The printing apparatus according to claim 3, wherein the processing unit displays a state of the consumed ink amount of the current memory unit in the user interface unit.

5. The printing apparatus according to claim 1, wherein the processing unit is further configured to execute the forced updating process regardless of a value of the consumed ink amount in a case where the instruction is inputted from a maintenance menu of the printing apparatus.

6. The printing apparatus according to claim 5, further comprising:

a storage unit, wherein the processing unit is configured to, in a case where the forced updating process has been executed in response to an instruction from the maintenance menu, store information enabling a day on which the forced updating process was executed to be specified in the storage unit.

7. The printing apparatus according to claim 2, wherein the processing unit is further configured to execute a setting of the prescribed threshold so as to delay a period in which the updating process is executed.

* * * * *